US008181957B2

(12) United States Patent
Kondo

(10) Patent No.: US 8,181,957 B2
(45) Date of Patent: May 22, 2012

(54) SHEET CONVEYING APPARATUS AND SHEET CONVEYING METHOD

(75) Inventor: Hirofumi Kondo, Yokohama (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 64 days.

(21) Appl. No.: 12/409,148

(22) Filed: Mar. 23, 2009

(65) Prior Publication Data

US 2010/0013149 A1 Jan. 21, 2010

Related U.S. Application Data

(60) Provisional application No. 61/081,684, filed on Jul. 17, 2008.

(51) Int. Cl.
*B65H 7/02* (2006.01)

(52) U.S. Cl. ..... 271/228; 271/227

(58) Field of Classification Search ..... 271/227, 271/228

See application file for complete search history.

(56) References Cited

U.S. PATENT DOCUMENTS

| | | | | |
|---|---|---|---|---|
| 5,662,321 | A * | 9/1997 | Borostyan et al. | 271/10.03 |
| 6,641,134 | B1 * | 11/2003 | Dobbertin et al. | 271/226 |
| 7,088,948 | B2 * | 8/2006 | Puckett et al. | 399/395 |
| 7,422,210 | B2 * | 9/2008 | Dejong et al. | 271/228 |
| 7,537,210 | B2 * | 5/2009 | Kawaguchi | 271/226 |
| 7,607,660 | B2 * | 10/2009 | Inoue | 271/228 |
| 7,775,518 | B2 * | 8/2010 | Kondo | 271/227 |
| 2002/0060416 | A1 * | 5/2002 | Dobberstein et al. | 271/227 |
| 2006/0208416 | A1 * | 9/2006 | Dejong et al. | 271/228 |
| 2007/0023995 | A1 * | 2/2007 | Onodera | 271/226 |
| 2008/0006992 | A1 * | 1/2008 | Inoue | 271/228 |
| 2009/0057994 | A1 * | 3/2009 | Kondo | 271/228 |
| 2009/0194936 | A1 * | 8/2009 | Choi | 271/228 |
| 2010/0052248 | A1 * | 3/2010 | Fushimi | 271/227 |

FOREIGN PATENT DOCUMENTS

| | | | |
|---|---|---|---|
| JP | 02095640 | A * | 4/1990 |
| JP | 03267244 | A * | 11/1991 |
| JP | PH11-349191 | | 12/1999 |
| JP | P2001-233506 | | 8/2001 |
| JP | P2007-137625 | | 6/2007 |
| JP | P2007-269421 | | 10/2007 |
| JP | P2008-024483 | | 2/2008 |

* cited by examiner

*Primary Examiner* — Kaitlin Joerger
*Assistant Examiner* — Prasad Gokhale
(74) *Attorney, Agent, or Firm* — Patterson & Sheridan, LLP

(57) ABSTRACT

To provide a sheet conveying technique that can realize highly accurate skew correction with an inexpensive and simple apparatus configuration. A sheet conveying apparatus includes: first and second rollers that are arranged in positions different from each other in a direction orthogonal to a sheet conveying direction and can be driven to rotate independently from each other; a first skew detecting unit that is arranged on an upstream side or a downstream side of the first and second rollers in the sheet conveying direction and detects skew of a sheet at first skew detection accuracy; and a second skew detecting unit that is arranged further on the downstream side than the first skew detecting unit in the sheet conveying direction and detects skew of the sheet at second skew detection accuracy higher than the first skew detection accuracy. A skew amount of the sheet is determined on the basis of detection results of the respective first and second skew detecting units. To reduce the determined skew amount, the first and second rollers are driven to rotate independently from each other and convey the sheet.

20 Claims, 20 Drawing Sheets

SHEET CONVEYING APPARATUS AND SHEET CONVEYING METHOD

CROSS-REFERENCE TO RELATED APPLICATION

This application is based upon and claims the benefit of priority from U.S. provisional application 61/081,684 filed on Jul. 17, 2008, the entire contents of each of which are incorporated herein by reference.

TECHNICAL FIELD

The present invention relates to a sheet conveying technique for conveying a sheet, and, more particularly to a technique for correcting skew of a conveyed sheet.

BACKGROUND

In the past, there is known a technique for arranging a pair of rollers in a direction orthogonal to a sheet conveying direction and performing sheet conveyance while controlling to drive each of the pair of rollers to cancel skew of a sheet detected by sensors.

Specifically, in the related art, a sheet conveyed by the roller pair is detected by a sensor pair including plural sensors arranged in positions different from each other in the direction orthogonal to the sheet conveying direction. The respective rollers configuring the roller pair are separately controlled to be driven on the basis of a result of the detection by the sensor pair to correct skew of the sheet (see, for example, JP-A-2001-233506).

In a sheet conveying apparatus in the past having the configuration explained above, in order to improve accuracy of skew correction for a conveyed sheet, for example, there is a method of adopting highly accurate sensors as the sensors that detect skew of the sheet. However, it is desirable not to use the highly accurate sensors without much thought because this leads to an increase in cost.

It is also possible to adopt a configuration for arranging plural sets of sensor pairs for detecting skew of a sheet in the sheet conveying direction and, every time skew of a sheet is detected by each of the sensor pairs, causing the roller pairs to perform skew correction of the sheet. However, even if the configuration is adopted, accuracy of skew detection by the respective sensor pairs is not improved. As a result of applying the skew correction in multiple stages in this way, skew of the sheet is not always highly accurately corrected.

SUMMARY

It is an object of an embodiment of the present invention to provide a sheet conveying technique that can realize highly accurate skew correction with an inexpensive and simple apparatus configuration.

In order to solve the problems, according to an aspect of the present invention, there is provided a sheet conveying apparatus including: first and second rollers that are arranged in positions different from each other in a direction orthogonal to a sheet conveying direction and can be driven to rotate independently from each other; a first skew detecting unit that is arranged on an upstream side or a downstream side of the first and second rollers in the sheet conveying direction and detects skew of a sheet at first skew detection accuracy; a second skew detecting unit that is arranged further on the downstream side than the first skew detecting unit in the sheet conveying direction and detects skew of the sheet at second skew detection accuracy higher than the first skew detection accuracy; a skew determining unit that determines a skew amount of the sheet on the basis of detection results of the respective first and second skew detecting units; and a driving control unit that controls to drive, to reduce the skew amount determined by the skew determining unit, the first and second rollers independently from each other and convey the sheet.

According to another aspect of the present invention, there is provided a sheet conveying apparatus including: first and second rollers that are arranged in positions different from each other in a direction orthogonal to a sheet conveying direction and can be driven to rotate independently from each other; plural skew detecting units that are arranged in different positions in the sheet conveying direction further on a downstream side than the first and second rollers in the sheet conveying direction and in which skew detection accuracy for a sheet by a skew detecting unit located on the most downstream side in the sheet conveying direction is set to be higher than that of a skew detecting unit located on an upstream side in the sheet conveying direction of the skew detecting unit located on the most downstream side; a skew determining unit that determines a skew amount of the sheet on the basis of detection results of the respective plural skew detecting units; and a driving control unit that controls to drive, to reduce the skew amount determined by the skew determining unit, the first and second rollers independently from each other and convey the sheet.

According to still another aspect of the present invention, there is provided a sheet conveying apparatus including: first and second rollers that are arranged in positions different from each other in a direction orthogonal to a sheet conveying direction and can be driven to rotate independently from each other; plural skew detecting units that are arranged in different positions in the sheet conveying direction further on a downstream side than the first and second rollers in the sheet conveying direction and in which an interval of a first section between a skew detecting unit located on the most downstream side in the sheet conveying direction and a skew detecting unit arranged to be adjacent to an upstream side of the skew detecting unit is set to be smaller than an interval of a second section between skew detecting units arranged to be adjacent to each other further on the upstream side in the sheet conveying direction than the first section; a skew determining unit that determines a skew amount of the sheet on the basis of detection results of the respective plural skew detecting units; and a driving control unit that controls to drive, to reduce the skew amount determined by the skew determining unit, the first and second rollers independently from each other and convey the sheet.

According to still another aspect of the present invention, there is provided a sheet conveying apparatus including: first and second rollers that are arranged in positions different from each other in a direction orthogonal to a sheet conveying direction and can be driven to rotate independently from each other; at least three skew detecting units that are arranged in positions different from one another near the first and second rollers in the sheet conveying direction and in which an interval of a first section between a skew detecting unit located on the most downstream side in the sheet conveying direction and a skew detecting unit arranged to be adjacent to an upstream side of the skew detecting unit is set to be smaller than an interval of a second section between skew detecting units arranged to be adjacent to each other further on the upstream side in the sheet conveying direction than the first section; a skew determining unit that determines a skew amount of the sheet on the basis of detection results of the respective plural skew detecting units; and a driving control unit that controls to drive, to reduce the skew amount determined by the skew determining unit, the first and second rollers independently from each other and convey the sheet.

According to still another aspect of the present invention, there is provided a sheet conveying apparatus including: first and second rollers that are arranged in positions different from each other in a direction orthogonal to a sheet conveying direction and can be driven to rotate independently from each other; and plural sensor pairs that are arranged on an upstream side or a downstream side or both the sides of the first and second rollers in the sheet conveying direction and in each of which at least two sensors are arranged in a direction orthogonal to the sheet conveying direction, wherein the plural sensor pairs include plural sensor pairs narrower than the width of a sheet having minimum width set in advance and one or more sensor pairs wider than the width of the sheet having the minimum width.

In the sheet conveying apparatus having the configuration explained above, a sensor pair on the most upstream side among the one or more sensor pairs wider than the minimum sheet width set in advance is arranged further on the downstream side than a sensor pair on the most upstream side among the plural sensor pairs narrower than the minimum sheet width.

According to still another aspect of the present invention, there is provided an image forming apparatus including: any one of the sheet conveying apparatuses having the configurations explained above; and a transfer roller that transfers a developer image onto a sheet conveyed by the sheet conveying apparatus, wherein the skew detecting unit located on the most downstream side is arranged further on the upstream side than the transfer roller in the sheet conveying direction.

According to still another aspect of the present invention, there is provided a sheet conveying method in a sheet conveying apparatus including: first and second rollers that are arranged in positions different from each other in a direction orthogonal to a sheet conveying direction and can be driven to rotate independently from each other; a first skew detecting unit that is arranged on an upstream side or a downstream side of the first and second rollers in the sheet conveying direction and detects skew of a sheet at first skew detection accuracy; and a second skew detecting unit that is arranged further on the downstream side than the first skew detecting unit in the sheet conveying direction and detects skew of the sheet at second skew detection accuracy higher than the first skew detection accuracy, the sheet conveying method including: determining a skew amount of the sheet on the basis of detection results of the respective first and second skew detecting units; and controlling to drive, to reduce the skew amount determined by the skew determining unit, the first and second rollers independently from each other and convey the sheet.

According to still another aspect of the present invention, there is provided a sheet conveying method in a sheet conveying apparatus including: first and second rollers that are arranged in positions different from each other in a direction orthogonal to a sheet conveying direction and can be driven to rotate independently from each other; and plural skew detecting units that are arranged in different positions in the sheet conveying direction further on a downstream side than the first and second rollers in the sheet conveying direction and in which skew detection accuracy for a sheet by a skew detecting unit located on the most downstream side in the sheet conveying direction is set to be higher than that of a skew detecting unit located on an upstream side in the sheet conveying direction of the skew detecting unit located on the most downstream side, the sheet conveying method including: determining a skew amount of the sheet on the basis of detection results of the respective plural skew detecting units; and controlling to drive, to reduce the skew amount determined by the skew determining unit, the first and second rollers independently from each other and convey the sheet.

According to still another aspect of the present invention, there is provided a sheet conveying program for causing a computer to execute a sheet conveying method in a sheet conveying apparatus including: first and second rollers that are arranged in positions different from each other in a direction orthogonal to a sheet conveying direction and can be driven to rotate independently from each other; a first skew detecting unit that is arranged on an upstream side or a downstream side of the first and second rollers in the sheet conveying direction and detects skew of a sheet at first skew detection accuracy; and a second skew detecting unit that is arranged further on the downstream side than the first skew detecting unit in the sheet conveying direction and detects skew of the sheet at second skew detection accuracy higher than the first skew detection accuracy, the sheet conveying program causing the computer to execute processing for: determining a skew amount of the sheet on the basis of detection results of the respective first and second skew detecting units; and controlling to drive, to reduce the skew amount determined by the skew determining unit, the first and second rollers independently from each other and convey the sheet.

According to still another aspect of the present invention, there is provided a sheet conveying program for causing a computer to execute a sheet conveying method in a sheet conveying apparatus including: first and second rollers that are arranged in positions different from each other in a direction orthogonal to a sheet conveying direction and can be driven to rotate independently from each other; and plural skew detecting units that are arranged in different positions in the sheet conveying direction further on a downstream side than the first and second rollers in the sheet conveying direction and in which skew detection accuracy for a sheet by a skew detecting unit located on the most downstream side in the sheet conveying direction is set to be higher than that of a skew detecting unit located on an upstream side in the sheet conveying direction of the skew detecting unit located on the most downstream side, the sheet conveying program causing the computer to execute processing for: determining a skew amount of the sheet on the basis of detection results of the respective first and second skew detecting units; and controlling to drive, to reduce the skew amount determined by the skew determining unit, the first and second rollers independently from each other and convey the sheet.

DETAILED DESCRIPTION

Embodiments of the present invention are explained below with reference to the accompanying drawings.

First Embodiment

Figure 1:
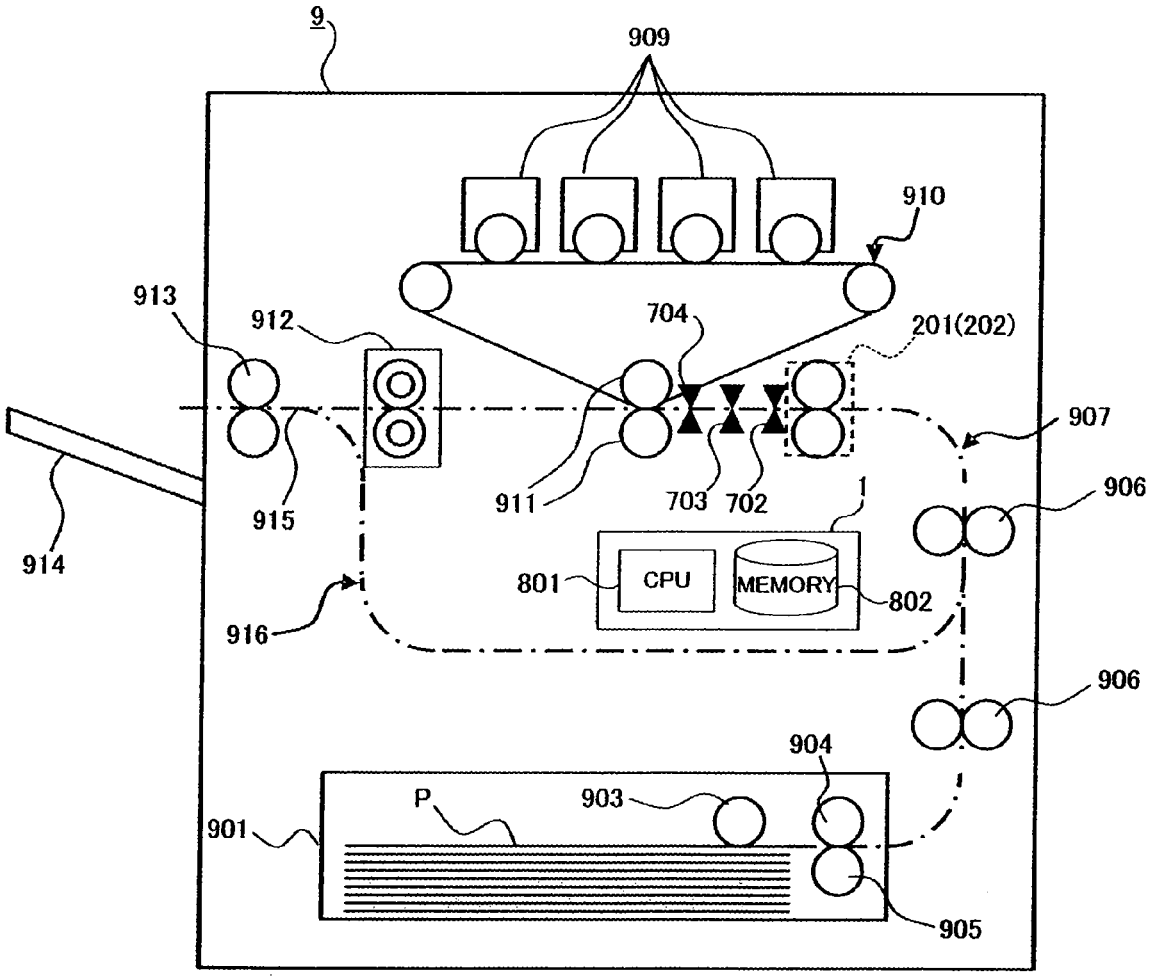
FIG. 1 is a schematic sectional view for explaining a sheet conveying apparatus and an image forming apparatus 9 including the sheet conveying apparatus according to a first embodiment of the present invention.

FIG. 1 is a schematic sectional view for explaining a sheet conveying apparatus and an image forming apparatus 9 including the sheet conveying apparatus according to a first embodiment of the present invention.

First, a configuration of the image forming apparatus 9 according to this embodiment and a flow of sheet conveyance processing in the image forming apparatus 9 are schematically explained.

In FIG. 1, sheets P stacked in a sheet feeding tray 901 are delivered by a pickup roller 903, separated by a feed roller 904 and a reverse roller 905 one by one, and sent to a conveying roller pair 906.

The sheet P conveyed through a sheet conveying path 907 is subjected to skew correction by registration rollers 201 and 202 serving as both sheet conveying means and skew correcting means controlled by a controller 1.

The image forming apparatus 9 is a color image forming apparatus. The registration rollers 201 and 202 perform adjustment of sheet conveying speed such that the sheet P is appropriately positioned on images formed on an intermediate transfer member 910 by four image forming units 909 (corresponding to, for example, four colors of yellow, magenta, cyan, and black). When the sheet P is conveyed to a predetermined transfer position, the sheet P is pressed against the intermediate transfer member 910 by a transfer roller 911. The developer images on the intermediate transfer member 910 are transferred onto the sheet P.

The developer images transferred onto the sheet P are heated and fixed by a fixing device 912. The sheet P having the developer images heated and fixed thereon is discharged onto a sheet discharge tray 914 by a sheet discharge roller 913.

When duplex printing is performed, the sheet P having an image formed on a first surface thereof is returned from a branching section 915 located on a downstream side of a fixing device 912 in a sheet conveying direction to a sheet feeding and conveying path 907 through a duplex conveyance path 916 (so-called switchback conveyance). An image is formed on a second surface of the sheet P as well and the sheet P is discharged onto the sheet discharge tray 914.

Figure 2:
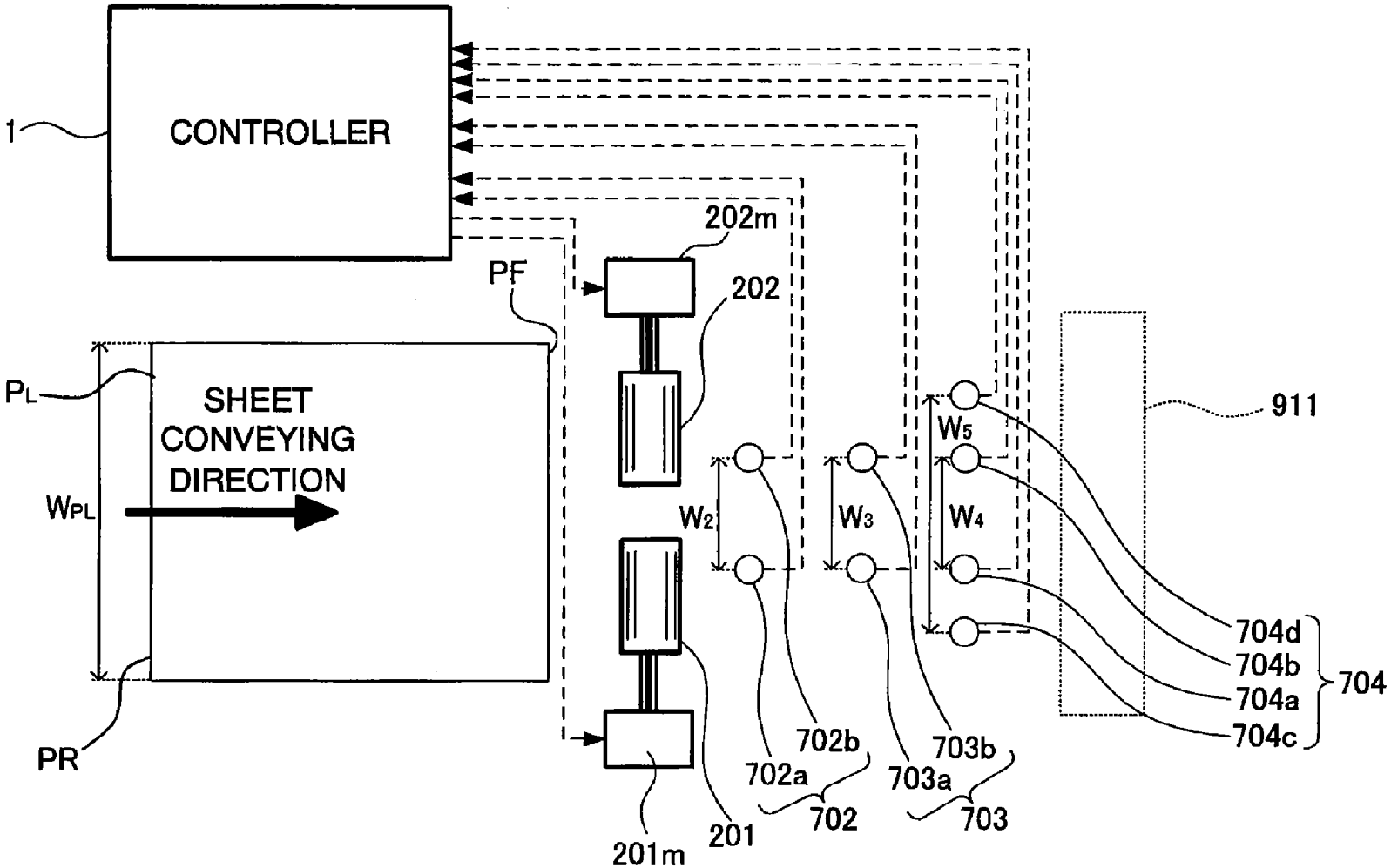
FIG. 2 is a diagram of a schematic configuration of the vicinity of registration rollers viewed from above in the sheet conveying apparatus according to the first embodiment.
Figure 3:
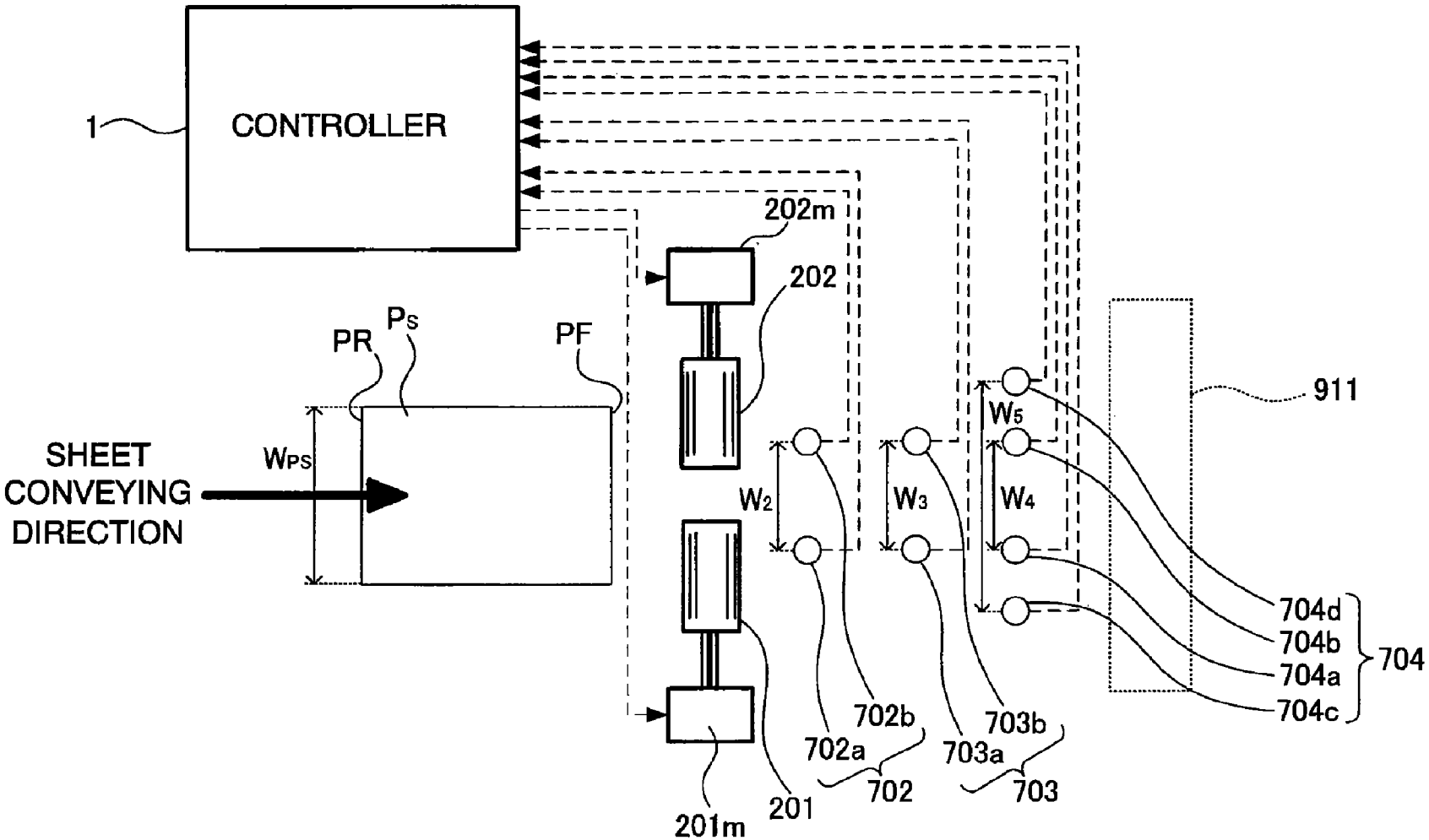
FIG. 3 is a diagram of a schematic configuration of the vicinity of the registration rollers viewed from above in the sheet conveying apparatus according to the first embodiment.
Figure 4:
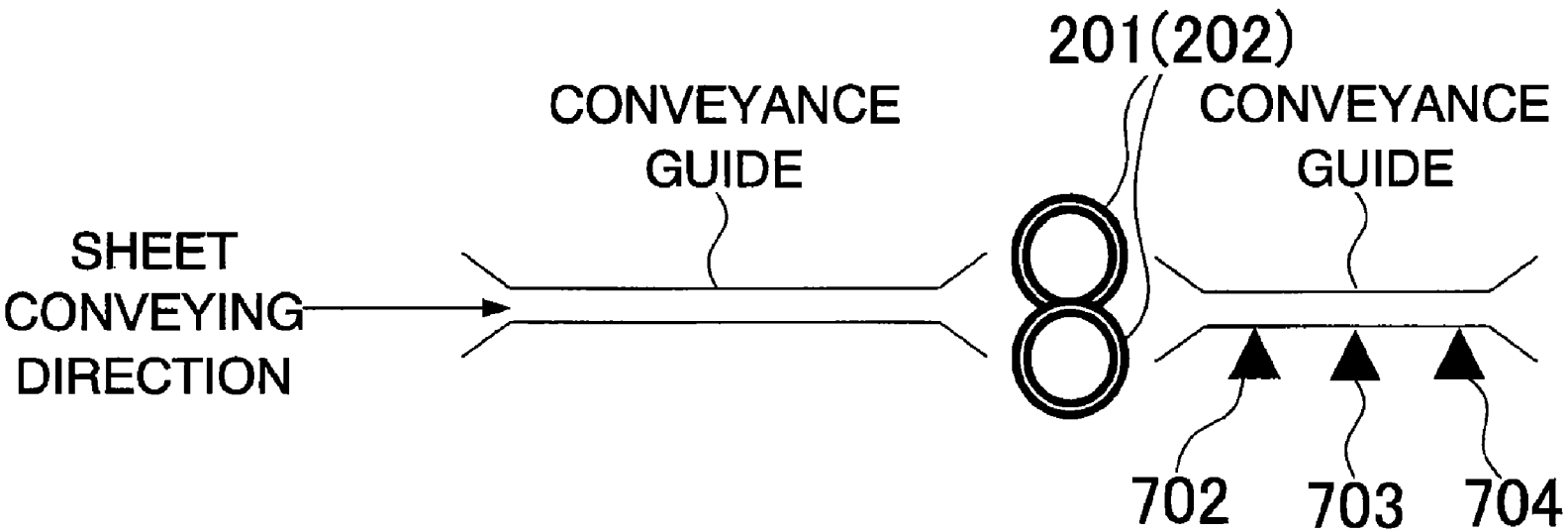
FIG. 4 is a diagram of a schematic configuration of a longitudinal section of the vicinity of the registration rollers viewed from a side (a rotation axis direction of the registration rollers) in the sheet conveying apparatus according to the first embodiment.

FIGS. 2 and 3 are diagrams of a schematic configuration of the vicinity of the registration rollers viewed from above in the sheet conveying apparatus according to the first embodiment. FIG. 4 is a diagram of a schematic configuration of a longitudinal section of the vicinity of the registration rollers viewed from a side (a rotation axis direction of the registration rollers) in the sheet conveying apparatus according to the first embodiment.

Specifically, the sheet conveying apparatus according to this embodiment includes the registration rollers 201 and 202, a skew detecting unit 702, a skew detecting unit 703, a skew detecting unit 704, and a controller 1. At least one of the skew detecting unit 702 and the skew detecting unit 703 corresponds to a "first skew detecting unit" and the skew detecting unit 704 corresponds to a "second skew detecting unit".

The arrangement of rollers and sensors in this embodiment is explained in detail below.

As shown in FIGS. 2 and 3, the registration roller 201 (a first roller) and the registration roller 202 (a second roller) are arranged in positions different from each other in a direction orthogonal to the sheet conveying direction (positions where the registration rollers 201 and 202 can nip the vicinities of both sides of a conveyed sheet). The registration rollers 201 and 202 can be respectively driven to rotate by motors 201*m* and 202*m* controlled to be driven by the controller 1. The registration rollers 201 and 202 are configured to be driven to rotate around the same rotating shaft orthogonal to the sheet conveying direction. Since the registration rollers 201 and 202 are respectively arranged in the positions where the registration rollers 201 and 202 can nip the vicinities of both sides of a conveyed sheet, it is possible to perform highly accurate angle adjustment when skew correction by these rollers is performed.

The skew detecting unit 702 including a sensor pair in which at least two sensors are arranged in positions different from each other in a direction orthogonal to the sheet conveying direction (a pair formed by a sensor 702*a* and a sensor 702*b*) is provided near the downstream side in the sheet conveying direction of the registration rollers 201 and 202.

The skew detecting unit 703 including a sensor pair in which at least two sensors are arranged in positions different from each other in the direction orthogonal to the sheet conveying direction (a pair formed by a sensor 703*a* and a sensor 703*b*) is provided near the downstream side of the skew detecting unit 702 in the sheet conveying direction.

The skew detecting unit 704 including at a sensor pair in which at least four sensors are arranged in positions different from one another in the direction orthogonal to the sheet conveying direction (a pair including a sensor 704*a*, a sensor 704*b*, a sensor 704*c*, and a sensor 704*d*) is provided near the downstream side of the skew detecting unit 703 in the sheet conveying direction.

The skew detecting units 702, 703, and 704 are arranged further on an upstream side than the transfer roller 911 in the sheet conveying direction. A distance in the sheet conveying direction from the nip of the registration rollers 201 and 202 to the skew detecting unit 704 is set to be smaller than length in the sheet conveying direction of a sheet that can be a conveying target (when plural sizes of sheets can be conveyed, a sheet having smallest length in the sheet conveying direction). Consequently, the skew detecting unit 704 can detect skew of the sheet in a state which the sheet is nipped by the registration rollers 201 and 202.

Each of the skew detecting units 702, 703, and 704 includes, for example, plural optical reflection sensors.

Specifically, the sensor pair configuring the skew detecting unit 702 is arranged to be spaced apart by a distance $W_2$ such that the sensor pair is located further on the outer side than a center position of the sheet in the direction orthogonal to the sheet conveying direction. The distance $W_2$ is set to 75% to 85% of width $W_{PS}$ of a sheet $P_S$ having smallest width (a size in the direction orthogonal to the sheet conveying direction) (e.g., a sheet of a postcard size) among plural sizes of sheets on which images can be formed by the image forming apparatus 9.

The sensor pair configuring the skew detecting unit 703 is arranged to be spaced apart by a distance $W_3$ such that the sensor pair is located further on the outer side than the center position of the sheet in the direction orthogonal to the sheet conveying direction. The distance $W_3$ is set substantially the same as the distance $W_2$.

The skew detecting unit 704 includes the sensors 704*a* and 704*b* arranged to be spaced apart by a distance $W_4$ and the sensors 704*c* and 704*d* arranged to be spaced apart by a distance $W_5$ such that the sensors are located further on the outer side than the center position of the sheet in the direction orthogonal to the sheet conveying direction. The distance $W_4$ is set substantially the same as the distances $W_2$ and $W_3$.

The distance $W_5$ is set to 75% to 85% of width $W_{PL}$ (a size in the direction orthogonal to the sheet conveying direction) of a sheet $P_L$ (e.g., a sheet of an A4-R size) most frequency conveyed (set as a target of image formation) among the plural sizes of sheets on which images can be formed by the image forming apparatus 9.

The space between the sensor pair configuring each of the skew detecting unit 702 and the skew detecting unit 703 (the first skew detecting unit) is narrower than minimum sheet width set in advance. The space (the distance $W_5$) between the sensor pair (the sensor 704*c* and 704*d*) configuring the skew detecting unit 704 (the second skew detecting unit) is wider than the minimum sheet width set in advance.

The space in the direction orthogonal to the sheet conveying direction between the sensors 704*c* and 704*d* configuring the skew detecting unit 704 located on the most downstream side in the sheet conveying direction is set wider than the space between each of the sensor pairs (the pair of sensors 702*a* and 702*b* and the pair of sensors 703*a* and 703*b*) configuring the skew detecting units 702 and 703 located on the upstream side in the sheet conveying direction of the skew detecting unit 704.

In this way, the sensors are arranged in the positions spaced apart by about 75% to 85% of the width of the sheet that should be detected. Therefore, it is possible to stably detect a sheet leading end PF (an end on the downstream side in the sheet conveying direction of the sheet) or a sheet trailing end PR (an end on the upstream side in the sheet conveying direction of the sheet) regardless of presence or absence of positional deviation in the direction orthogonal to the sheet conveying direction of the sheet, turn-up of a corner of the sheet during conveyance, flopping of an end of the sheet during conveyance, or the like.

The space between each of the sensor pairs is set to about 75% to 85% of the width of the sheet as the detection target because a phenomenon explained below could occur. If the space between the sensor pair is set to be equal to or smaller than 75% of the width, a distance between the sensors cannot be sufficiently secured and sufficient detection accuracy is not obtained in performing highly accurate skew detection (for details, see explanation concerning Formula (1) below). If the space between the sensor pair is set to be equal to or larger than 85%, for example, when a conveyed sheet is conveyed in a state of lateral shift or the like, the sheet passes through any one of the two sensors configuring the sensor pair without being detected and skew of the sheet cannot be detected.

In this embodiment, the skew detecting units 702, 703, and 704 are arranged at equal intervals in the sheet conveying direction.

The registration rollers 201 and 202 are controlled to be driven by the controller 1 on the basis of detection results of the respective skew detecting units 702, 703, and 704 arranged as explained above.

Figure 5:
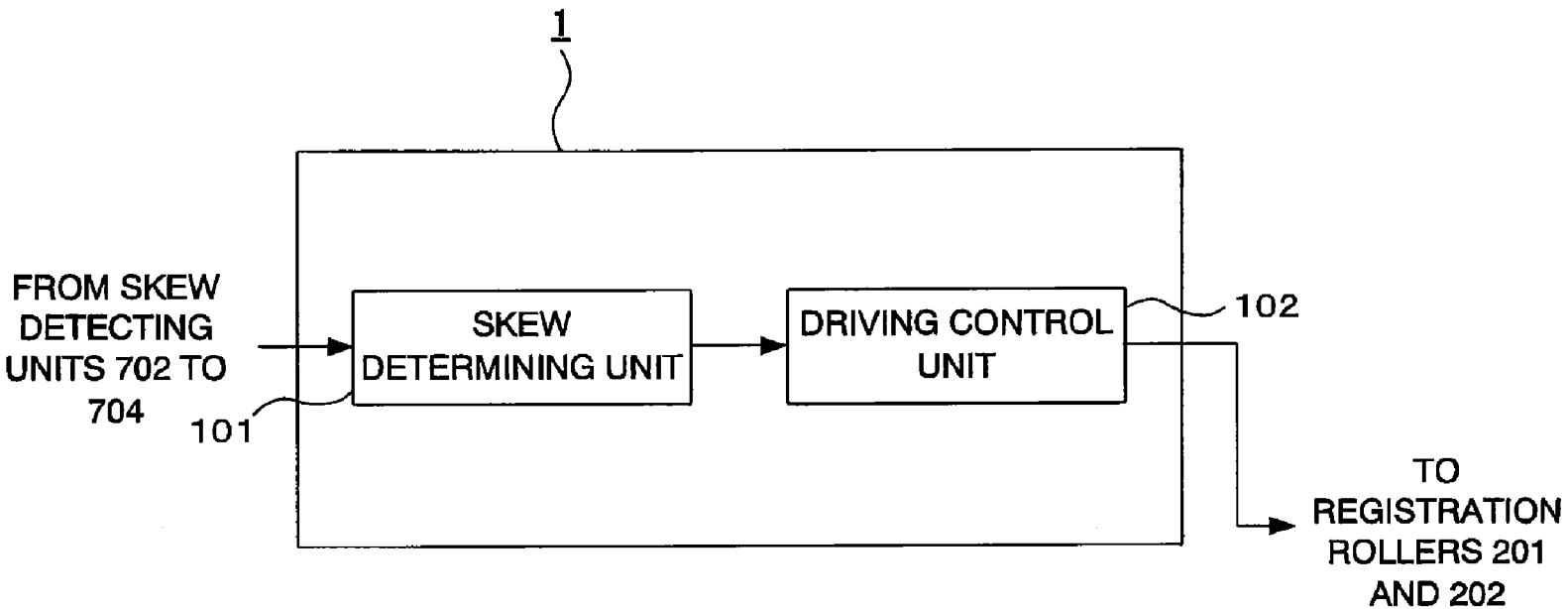
FIG. 5 is a functional block diagram for explaining details of a controller 1 in the sheet conveying apparatus according to the first embodiment.

FIG. 5 is a functional block diagram for explaining details of the controller 1 in the sheet conveying apparatus according to the first embodiment.

The controller 1 according to this embodiment includes functional blocks having functions of a skew determining unit 101 and a driving control unit 102. These functional blocks are realized by a CPU 801 and a memory 802 (see FIG. 1) included in the controller 1.

The CPU 801 has a role of performing various kinds of processing in the sheet conveying apparatus and also has a role of realizing various functions by executing a computer program stored in the memory 802. The memory 802 can be, for example, a RAM (Random Access Memory), a ROM (Read Only Memory), a DRAM (Dynamic Random Access Memory), an SPAM (Static Random Access Memory), or a VRAM (Video RAM). The memory 802 has a role of storing various kinds of information and computer programs used in the sheet conveying apparatus.

Details of the respective functional blocks are explained below.

The skew determining unit 101 sequentially determines skew amounts of a conveyed sheet on the basis of detection results of the sheet leading end PF or the sheet trailing end PR sequentially obtained by the skew detecting units 702, 703, and 704 during sheet conveyance.

The driving control unit 102 controls, to reduce the skew amounts determined by the skew determining unit 101, each of the motor 201*m* and the motor 202*m* separately to drive to rotate the registration rollers 201 and 202 and convey the sheet.

Figure 6:
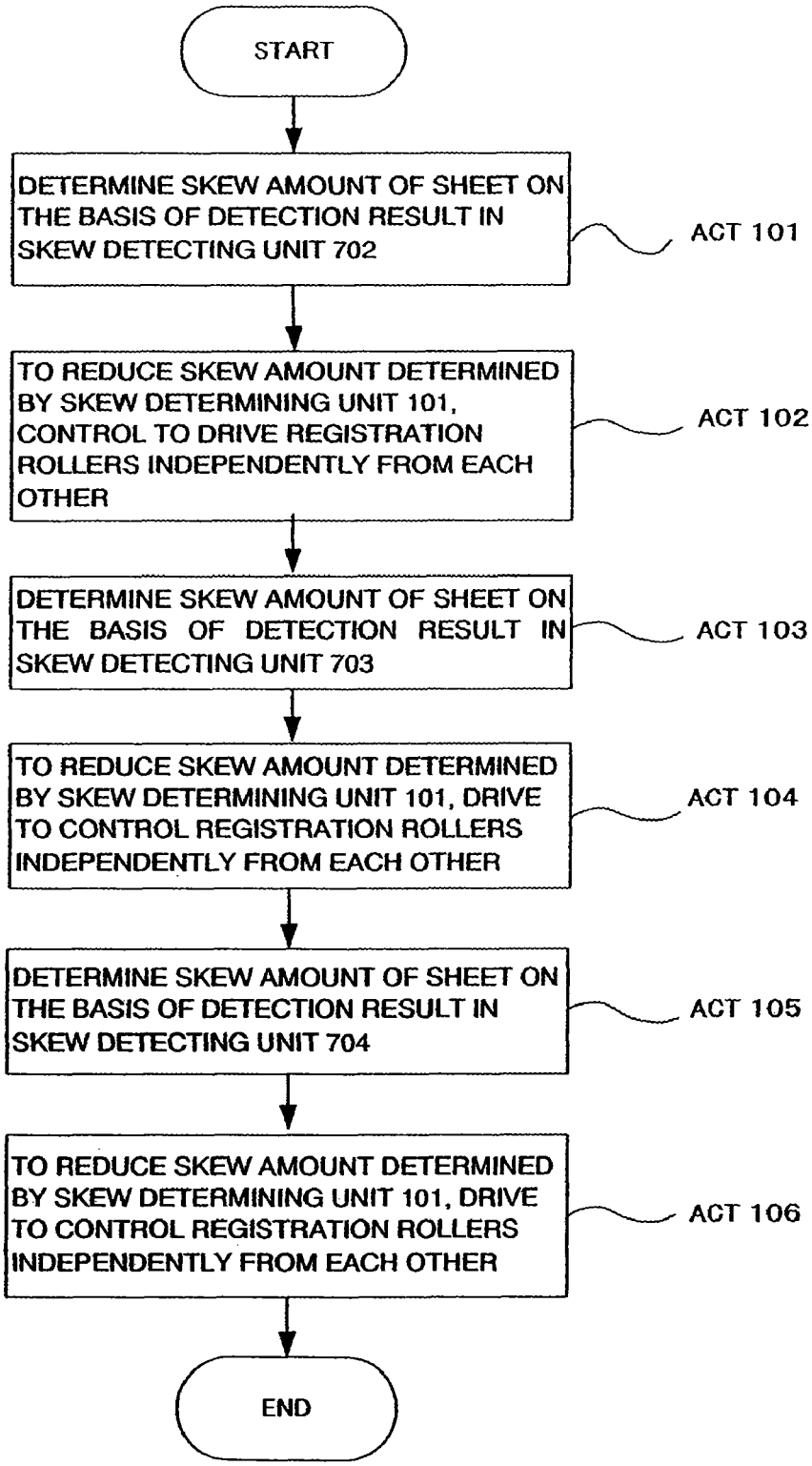
FIG. 6 is a flowchart for explaining a flow of processing in the sheet conveying apparatus according to the first embodiment.

Details of a sheet conveying operation in the sheet conveying apparatus according to this embodiment are explained below. FIG. 6 is a flowchart for explaining a flow of processing in the sheet conveying apparatus according to this embodiment.

First, the skew determining unit 101 determines a skew amount at a point when a sheet passes the skew detecting unit 702 on the basis of a detection result of the sheet leading end PF in the skew detecting unit 702 (ACT 101).

The driving control unit 102 controls, to reduce the skew amount determined by the skew determining unit 101, each of the motor 201*m* and the motor 202*m* separately to drive to rotate the registration rollers 201 and 202 and convey the sheet (ACT 102).

Subsequently, the skew determining unit 101 determines a skew amount at a point when the sheet passes the skew detecting unit 703 on the basis of a detection result of the sheet leading end PF in the skew detecting unit 703 (ACT 103).

The driving control unit 102 controls, to reduce the skew amount determined by the skew determining unit 101, each of the motor 201*m* and the motor 202*m* separately to drive to rotate the registration rollers 201 and 202 and convey the sheet (ACT 104).

The skew determining unit 101 determines a skew amount at a point when the sheet passes the skew detecting unit 704 on the basis of a detection result of the sheet leading end PF in the skew detecting unit 704 (ACT 105).

Finally, the driving control unit 102 controls, to reduce the skew amount determined by the skew determining unit 101, each of the motor 201*m* and the motor 202*m* separately to drive to rotate the registration rollers 201 and 202 and convey the sheet to the transfer roller 911 (ACT 106).

Details of skew correction processing based on a detection result in a skew detecting unit are explained below.

Figure 7:
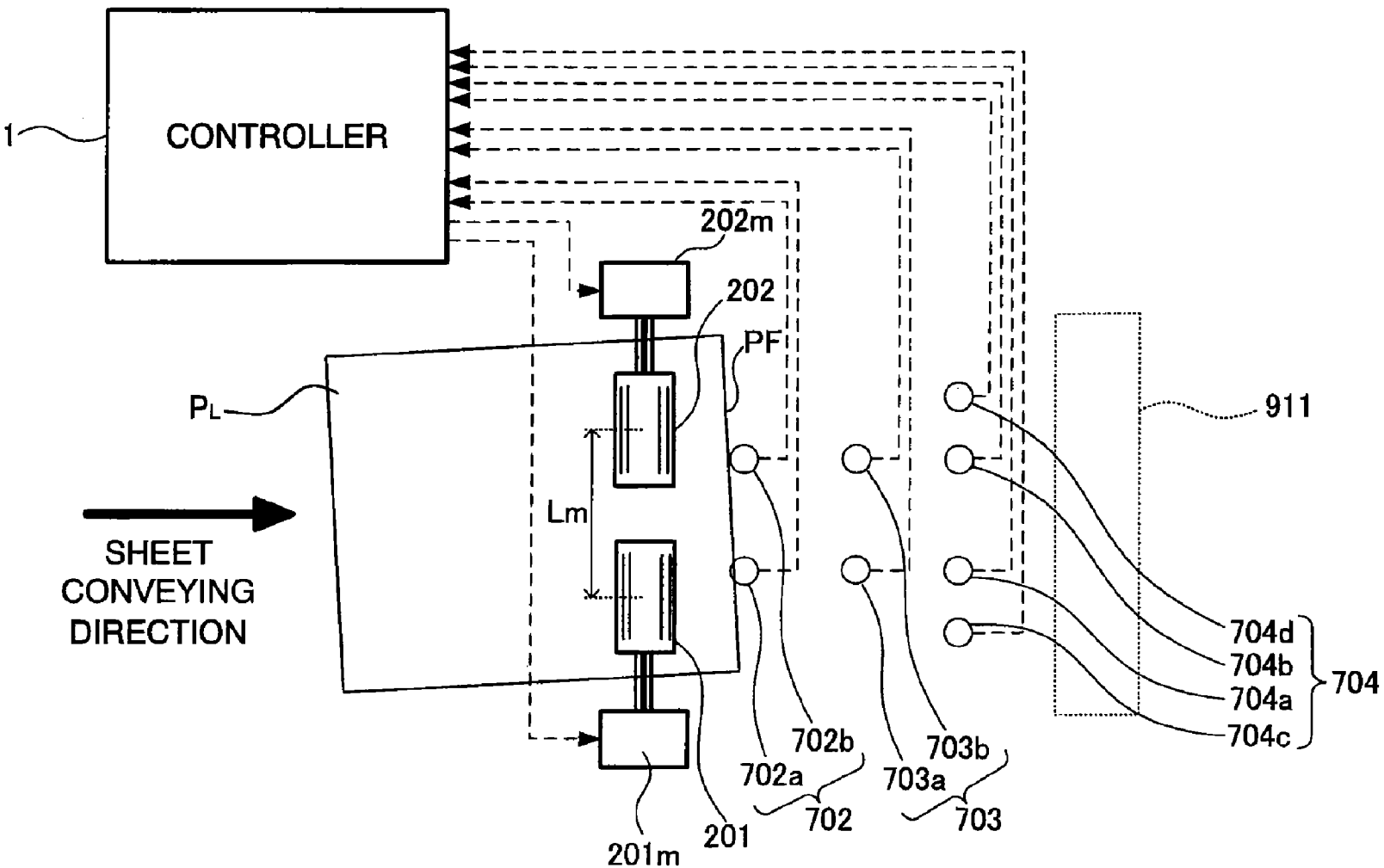
FIG. 7 is a diagram of a state in which a leading end PF of a sheet $P_L$ of a size frequently conveyed in the image forming apparatus 9 passes a skew detecting unit 702.

FIG. 7 is a diagram of a state in which the leading end PF of the sheet $P_L$ having a size (e.g., the A4-R size) frequently conveyed in the image forming apparatus 9 passes the skew detecting unit 702 (the sensors 702*a* and 702*b*).

The controller 1 calculates, from a skew amount determined on the basis of detection results of the sensors 702*a* and 702*b*, driving speed of the motors 201*m* and 202*m* necessary for reducing the skew amount using the registration rollers 201 and 202 and controls the registration rollers 201 and 202.

In FIG. 7, when the sheet leading end PF passes the sensor 702*a* or 702*b*, a sensor signal of the sensor that detects the sheet $P_L$ is switched from OFF to ON.

If the sheet $P_L$ skews as shown in FIG. 7, the sensor 702*a* is turned ON earlier by a preceding side of the sheet leading end PF and the sensor 702*b* is turned ON later by a delaying side.

A time difference between time when the sheet leading end PF is detected by the sensor 702*a* and time when the sheet leading end PF is detected by the sensor 702*b* is represented as "Δt", average conveying speed of the registration rollers 201 and 202 is represented as "V", and a distance between the sensors 702*a* and 702*b* is represented as "$W_2$". An estimation value of a skew amount θ (an angle) is represented by the following formula:

$$\theta=(V\times\Delta t)/W_2[rad] \quad (1)$$

To correct skew of the sheet to a regular position with the registration rollers 201 and 202, roller speed only has to be controlled such that a difference between circumferential speeds of the rollers (ΔV=Va−Vb: Va is the circumferential speed of the registration roller 201 and Vb is the circumferential speed of the registration roller 202) satisfies the following formula:

$$\theta+\int\beta(\Delta v/Lm)dt=0 \quad (2)$$

(an integral range is a period from skew correction start time t1 to skew correction end time t2)

"Lm" represents a distance between center positions in a width direction of the roller nip of the registration rollers 201 and 202. "β" represents a correction coefficient for correcting an effective distance between both the rollers and is a value that could fluctuate according to a sheet type, sheet thickness, and sheet size. In a simplest example in which "V" is a fixed value (uniform speed), Formula (2) is changed to the following formula:

$$\theta+(\beta\times((Va-Vb)/Lm)\times(t2-t1))=0 \quad (3)$$

(an integral range is a period from skew correction start time t1 to skew correction end time t2)

$$\text{where, } V=(Va+Vb)/2 \quad (4)$$

Therefore, if the roller speed is controlled to satisfy the following formulas:

$$Va=V-((Lm\times\theta)/(2\times\beta\times(t2-t1) \quad (5)$$

$$Vb=V+((Lm\times\theta)/(2\times\beta\times(t2-t1) \quad (6)$$

the skew is corrected.

Figure 8:
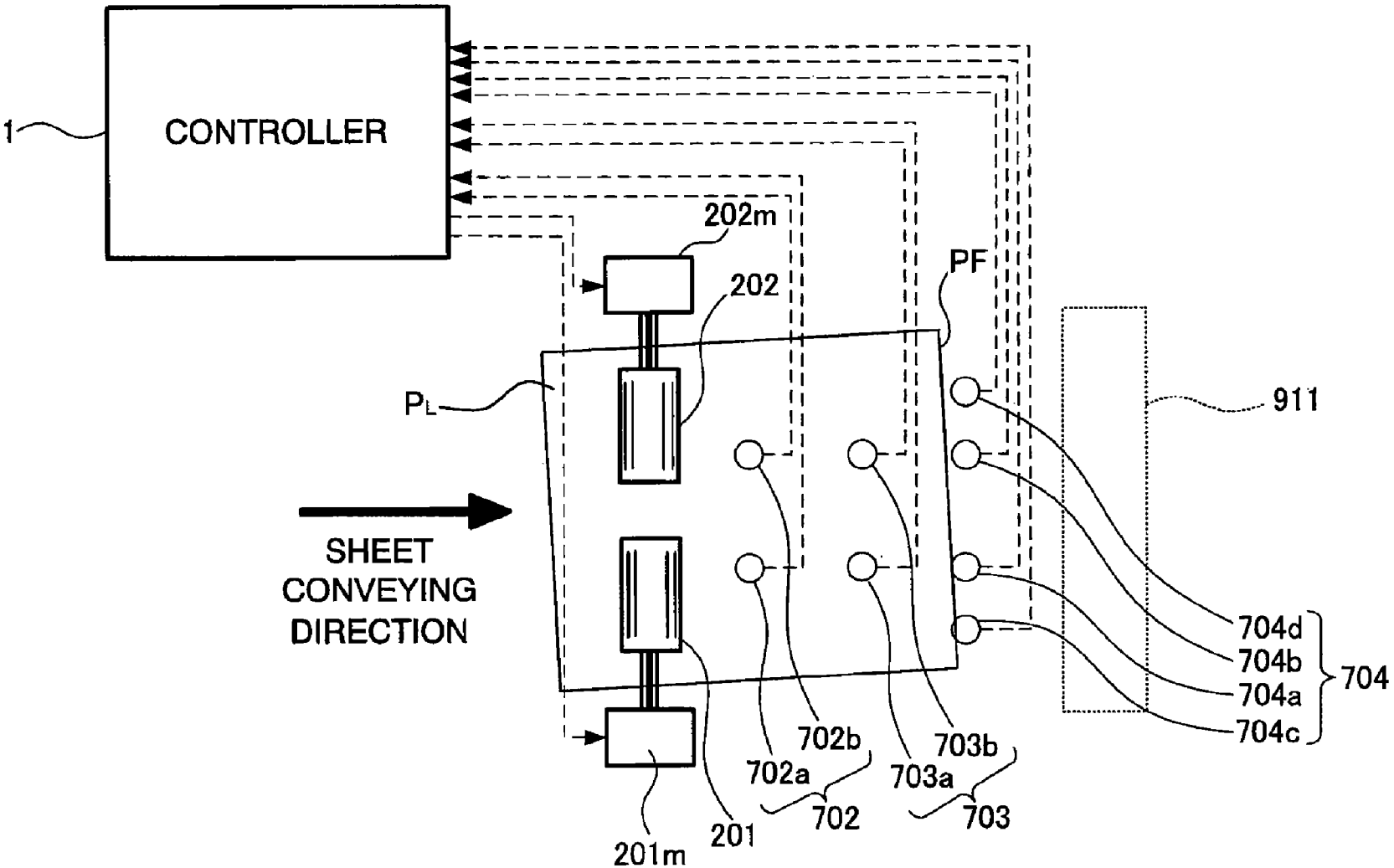
FIG. 8 is a diagram of a state in which the leading end PF of the sheet $P_L$ of the size frequently conveyed in the image forming apparatus 9 passes a skew detecting unit 704.

FIG. 8 is a diagram of a state in which the leading end PF of the sheet $P_L$ having the size (e.g., the A4-R size) frequently conveyed in the image forming apparatus 9 passes the skew detecting unit 704 (the sensors 704*a* to 704*d*).

Sheet skew detection accuracies in the skew detecting unit 702 and the skew detecting unit 703 are considered to be basically the same when spaces between the sensors of both the sensor pairs are the same (i.e., $W_2=W_3$) and detection accuracies (e.g., stabilities and response speeds) of the sensors configuring both the sensor pairs are the same. The sheet skew detection accuracies in the skew detecting unit 702 and the skew detecting unit 703 correspond to "first skew detection accuracy". On the other hand, the skew detecting unit 704 has the sensor pair including the sensors 704*c* and 704*d* arranged a space apart from each other wider than the spaces between the sensor pairs configuring the skew detecting unit 702 and the skew detecting unit 703, respectively.

As it is seen from Formula (1), as a space between two sensors configuring a sensor pair is wider, accuracy for detecting skew of a sheet increases. Therefore, if detection results of the sensors 704*c* and 704*d* at the time when the sheet $P_L$ passes the skew detecting unit 704 are used, it is possible to perform skew detection at accuracy higher than those of the skew detecting unit 702 and the skew detecting unit 703. The sheet skew detection accuracy of the skew detecting unit 704 corresponds to "second skew detection accuracy".

In other words, the sheet skew detection accuracy of the skew detecting unit 704 located on the most downstream side in the sheet conveying direction is higher than those of the skew detecting units 702 and 703 located on the upstream side in the sheet conveying direction of the skew detecting unit 704. In the sheet conveying apparatus according to this embodiment, in a skew detecting unit arranged on the most downstream side among plural skew detecting units arranged along the sheet conveying direction, a sensor pair having a wider space than those of sensor pairs configuring skew detecting units located further on the upstream side than the skew detecting unit is included. Consequently, sheet detection accuracy of at least the skew detecting unit located on the most downstream side is improved and a sheet corrected to reduce a skew amount as much as possible is conveyed to the transfer roller 911.

As explained above, a space between sensors configuring a sensor pair is varied according to a setting position in the sheet conveying direction. Therefore, it is possible to highly accurately detect skew of a conveyed sheet even if highly accurate (expensive) sensors are not specially adopted. As a result, it is possible to contribute to improvement of sheet conveyance performance of the sheet conveying apparatus and improvement of a quality of an image formed in the image forming apparatus.

The skew detecting unit 704 in this embodiment includes a sensor group in which four sensors are arranged in the direction orthogonal to the sheet conveying direction. For example, plural forms indicated by (1) to (3) below are conceivable concerning detection results of which of the sensors are used to determine a skew amount of a sheet in the skew determining unit 101.

(1) A skew amount of the sheet is calculated on the basis of only detection results of the sensors 704*c* and 704*b*.

(2) Detection results of the sensors 704*a* and 704*b* and detection results of the sensors 704*c* and 704*d* are compared and a skew amount of the sheet is calculated on the basis of a larger value or a smaller value of the detection results.

(3) An average of a sheet skew amount calculated on the basis of detection results of the sensors 704*a* and 704*b* and a sheet skew amount calculated on the basis of detection results of the sensors 704*c* and 704*d* is set as a sheet skew amount.

It goes without saying that it is possible to appropriately select any one of the forms (1) to (3) and other calculation methods according to assembly accuracy of sensors in an actual apparatus, characteristics of the respective sensors, and the like.

Besides, when, for example, six or more sensors (three or more sensor pairs) are adopted as a skew detecting unit arranged on the most downstream side in the sheet conveying direction, it is also possible to calculate skew of a sheet on the basis of a median of detection values in the six or more sensors.

Second Embodiment

A second embodiment of the present invention is explained below.

The second embodiment is a modification of the first embodiment. In the following explanation, in this embodiment, components having functions same as those explained in the first embodiment are denoted by the same reference numerals and signs and explanation of the components is omitted.

Figure 9:
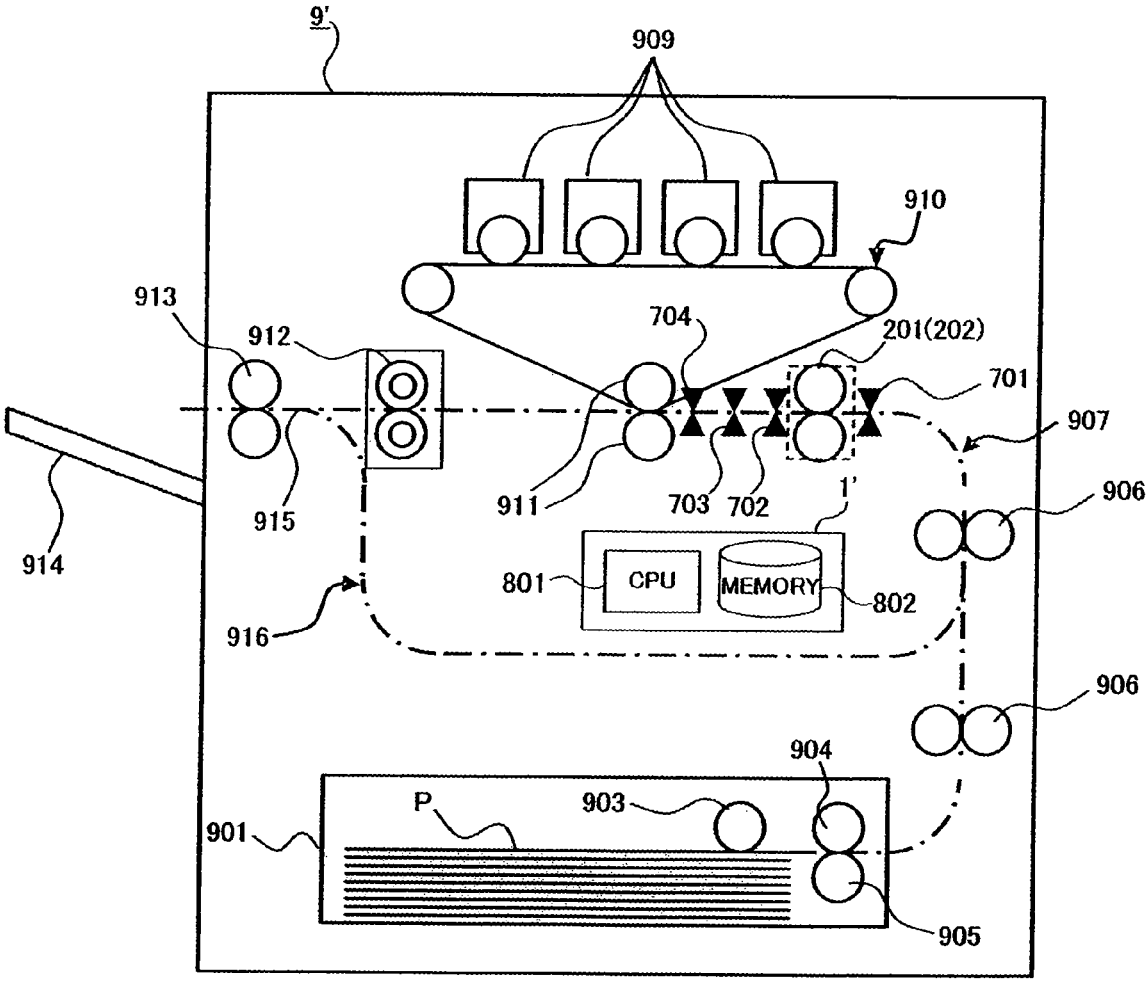
FIG. 9 is a schematic sectional view for explaining a sheet conveying apparatus and an image forming apparatus 9' including the sheet conveying apparatus according to a second embodiment of the present invention.
Figure 10:
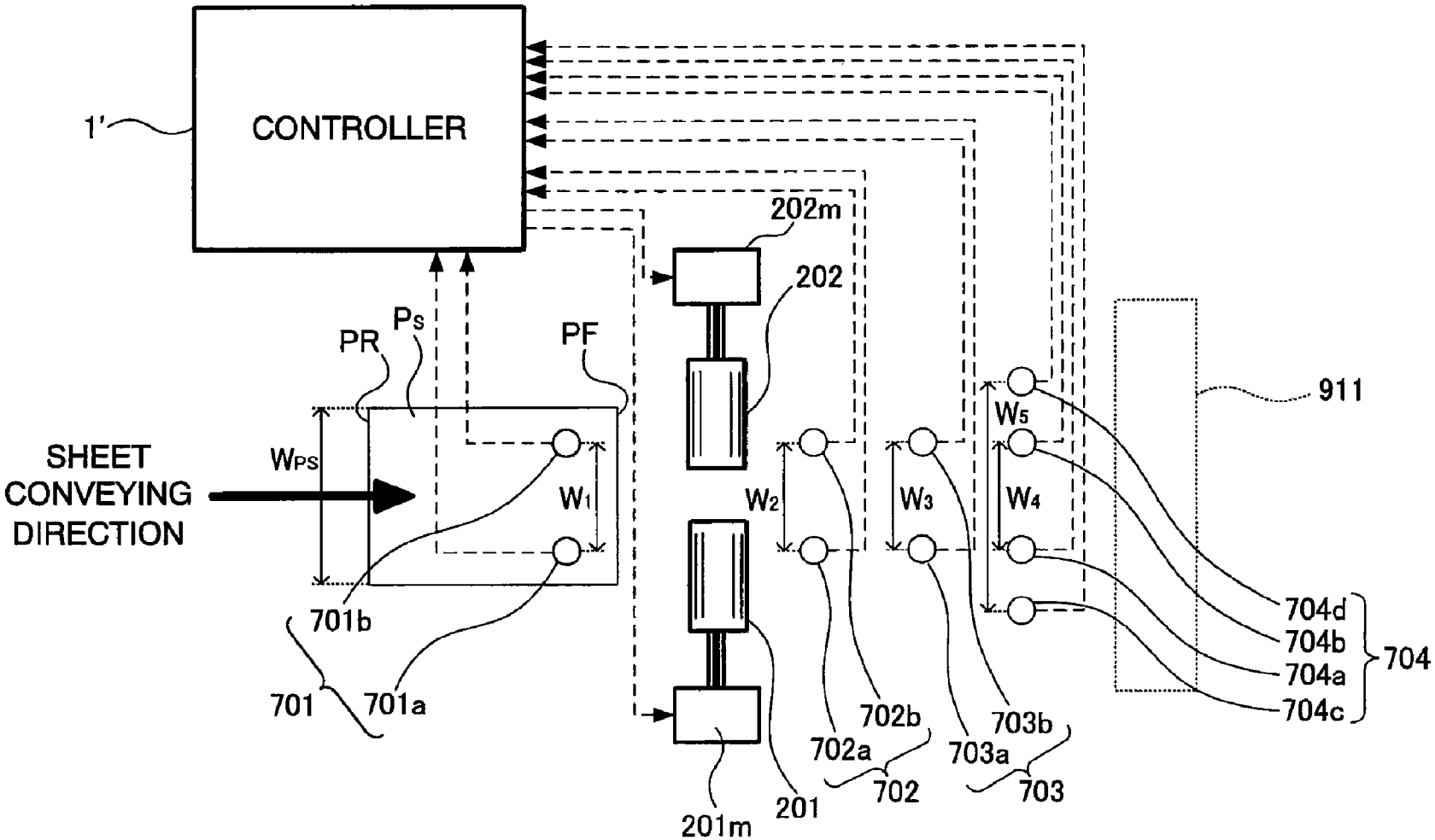
FIG. 10 is a diagram of a schematic configuration of the vicinity of registration rollers viewed from above in the sheet conveying apparatus according to the second embodiment.

FIG. 9 is a schematic sectional view for explaining a sheet conveying apparatus and an image forming apparatus 9' including the sheet conveying apparatus according to the second embodiment. FIG. 10 is a diagram of a schematic configuration of the vicinity of registration rollers viewed from above in the sheet conveying apparatus according to the second embodiment.

As shown in FIGS. 9 and 10, in the sheet conveying apparatus according to this embodiment, in addition to the components in the first embodiment, an upstream-side skew detecting unit 701 (corresponding to the first skew detecting unit), in which at least two sensors (a sensor 701*a* and a sensor 701*b*) are arranged in the direction orthogonal to the sheet conveying direction, is provided near the upstream side in the sheet conveying direction of the registration roller 201 (the first roller) and the registration roller 202 (the second roller) (see FIG. 10). In the sheet conveying apparatus, usually, sensors for detecting sheet jam are provided near the upstream side of the registration rollers 201 and 202. Therefore, it is also possible to use the sensors for jam detection as the skew detecting unit 701.

Like the skew detecting units 702 and 703 explained in the first embodiment, the upstream-side skew detecting unit 701 includes a sensor pair arranged at a space $W_1$ (i.e., $W_1=W_2=W_3=W_4$) equivalent to 75% to 85% of the width $W_{PS}$ of the sheet $P_S$ (e.g., a sheet of the postcard size) having smallest width (a size in the direction orthogonal to the sheet conveying direction) among sheets of sizes on which images can be formed by the image forming apparatus 9' (see FIG. 10).

Figure 11:
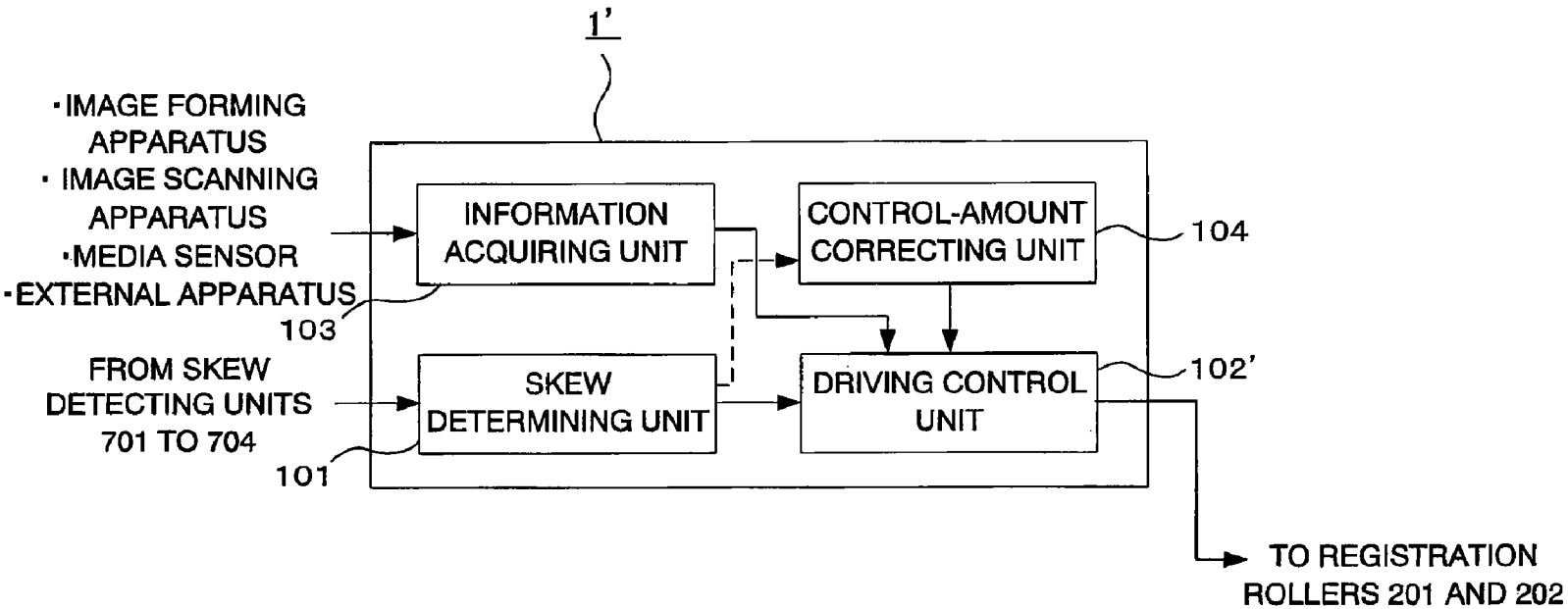
FIG. 11 is a functional block diagram for explaining details of a controller 1' in the sheet conveying apparatus according to the second embodiment.

FIG. 11 is a functional block diagram for explaining details of a controller 1' in the sheet conveying apparatus according to the second embodiment.

The controller 1' according to this embodiment includes functional blocks having functions of the skew determining unit 101, a driving control unit 102', an information acquiring unit 103, and a control-amount correcting unit 104. These functional blocks are realized by the CPU 801 and the memory 802 (see FIG. 9) included in the controller 1'.

In addition to the function of the driving control unit 102 in the first embodiment, the driving control unit 102' has a function of setting, when the sheet P, the end PF on the downstream side in the sheet conveying direction of which is detected by the upstream-side skew detecting unit 701, enters the nip of the registration rollers 201 and 202, rotation speeds of the registration rollers 201 and 202 different to correct skew of the sheet P.

The driving control unit 102' can set, when a skew amount determined by the skew determining unit 101 is equal to or larger than a predetermined value, for example, sheet conveying speed of the registration rollers 201 and 202 (circumferential speed of the registration rollers 201 and 202) lower than sheet conveying speed set when a skew amount determined by the skew determining unit 101 is smaller than the predetermined value and cause the registration rollers 201 and 202 to perform skew correction in a state in which there is enough time for the skew correction. Timing for starting to reduce the sheet conveying speed of the registration rollers 201 and 202 may be, for example, timing when the upstream-side skew detecting unit 701 detects a skew amount equal to or larger than the predetermined value or may be timing delayed from the timing by a predetermined time.

Besides, the driving control unit 102' can also stop the sheet conveyance by the registration rollers 201 and 202 when a skew amount determined by the skew determining unit 101 is equal to or larger than the predetermined value.

Further, the driving control unit 102' can also perform, on the basis of information (explained later) acquired by the information acquiring unit 103, mode switching between a first mode and a second mode. The first mode is a mode for setting, when a skew amount determined by the skew determining unit 101 is equal to or larger than the predetermined value, sheet conveying speed of the registration rollers 201 and 202 lower than sheet conveying speed set when a skew amount determined by the skew determining unit 101 is smaller than the predetermined value and causing the registration rollers 201 and 202 to perform skew correction. The second mode is a mode for stopping, when a skew amount determined by the skew determining unit 101 is equal to or larger than the predetermined value, the sheet conveyance by the registration rollers 201 and 202 to perform skew correction and then resuming the sheet conveyance.

The information acquiring unit 103 acquires, from a media sensor or the like provided in the image forming apparatus or the sheet conveying apparatus, information concerning a type of a sheet as a conveyance target in the sheet conveying apparatus. Specifically, the "information concerning a type of a sheet" means, besides surface roughness, reflectance, and the like as parameters concerning smoothness of a sheet surface, factors such as the thickness and a type of the sheet that are likely to affect angle adjustment for the sheet when skew correction by registration rollers is performed. Timing for the information acquisition by the information acquiring unit 103 may be any timing before the execution of skew correction control by the driving control unit 102'.

The control-amount correcting unit 104 corrects a control amount during the skew correction control by the driving control unit 102' for a sheet conveyed following the sheet as the conveyance target on the basis of a difference between a skew amount determined by the skew determining unit 101 on the basis of a detection result in the upstream-side skew detecting unit 701 at the end PF on the downstream side in the sheet conveying direction of the sheet as the conveyance target and a skew amount determined by the skew determining unit 101 on the basis of a detection result in the upstream-side skew detecting unit 701 at the end PR on the upstream side in the sheet conveying direction of the sheet conveyed by the registration rollers 201 and 202 in a state in which the skew correction control by the driving control unit 102' is not performed. The calculated correction amount can be stored in, for example, the memory 802 or the like and read out when necessary.

Figure 12:
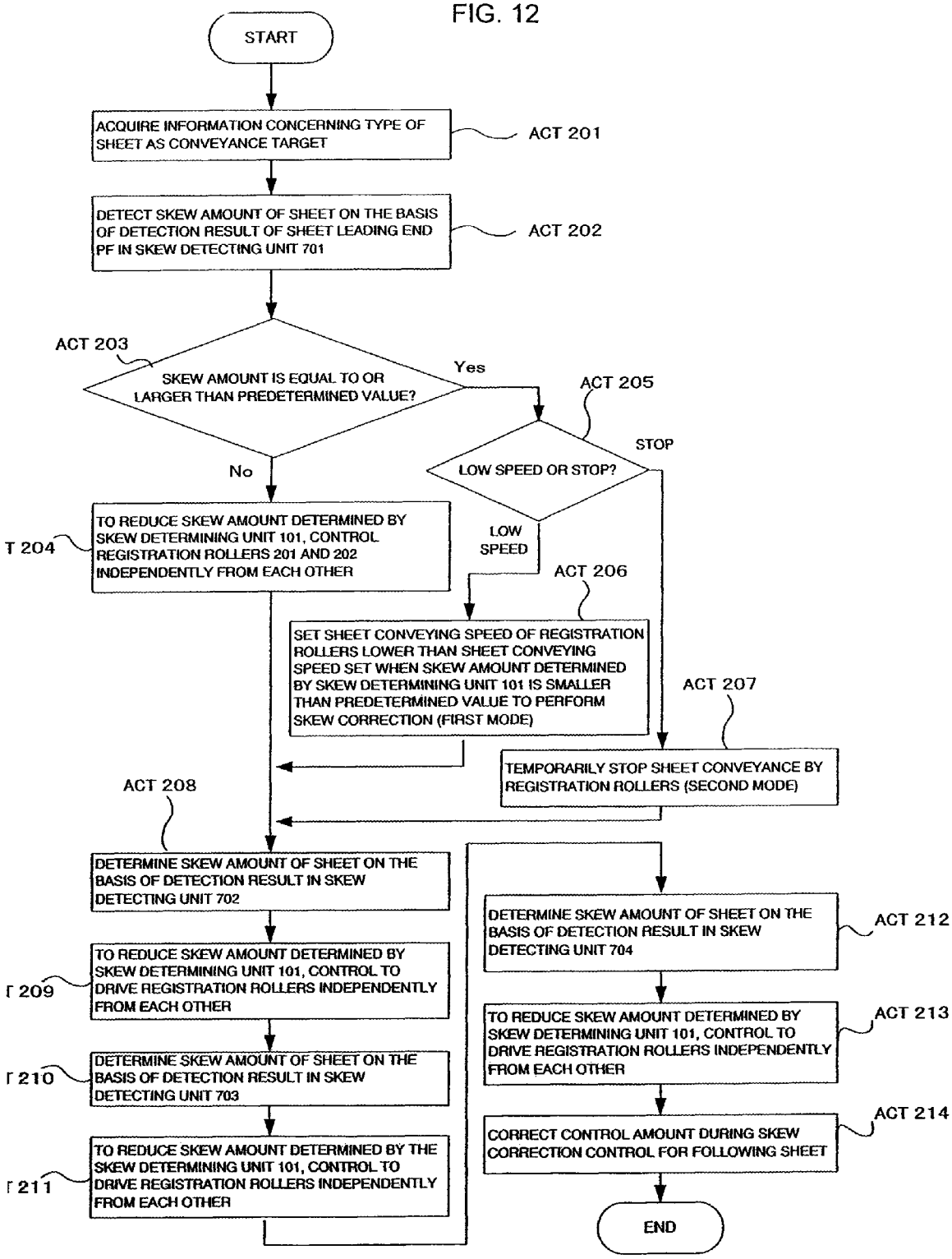
FIG. 12 is a flowchart for explaining a flow of processing in the sheet conveying apparatus according to the second embodiment.

Details of a sheet conveying operation in the sheet conveying apparatus according to this embodiment are explained below. FIG. 12 is a flowchart for explaining a flow of processing in the sheet conveying apparatus according to this embodiment.

First, the information acquiring unit 103 acquires information concerning a type of a sheet as a conveyance target in the sheet conveying apparatus (ACT 201).

Figure 13:
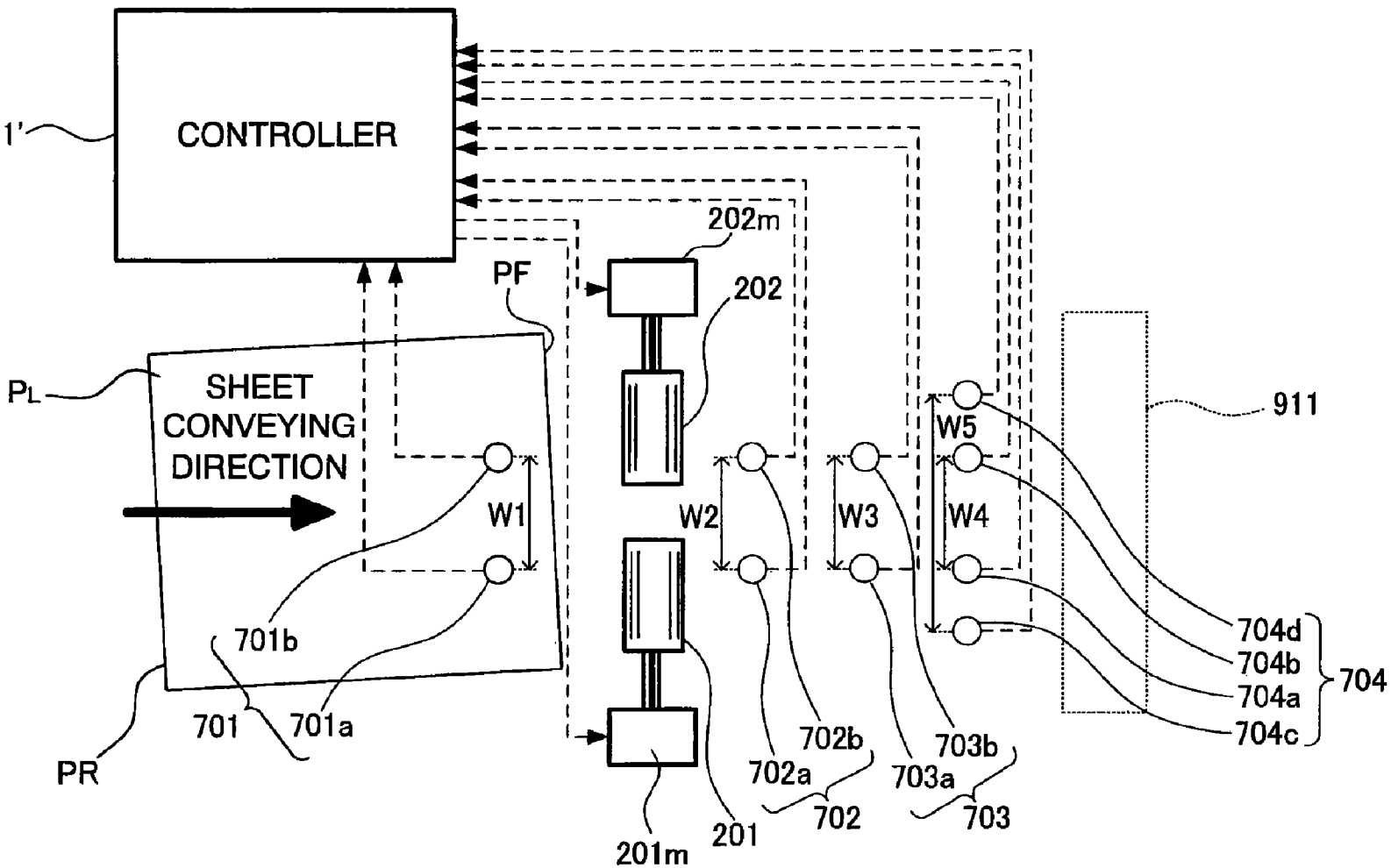
FIG. 13 is a diagram of a sheet conveyance state in the sheet conveying apparatus according to the second embodiment.

The skew determining unit 101 determines a skew amount of a conveyed sheet on the basis of a detection result of the sheet leading end PF in the upstream-side skew detecting unit 701 (ACT 202) (see FIG. 13).

If the skew amount of the sheet is smaller than a predetermined value (ACT 203, No), to reduce the skew amount determined by the skew determining unit 101, the driving control unit 102' causes the sheet to enter the roller nip in a state in which the registration rollers 201 and 202 are controlled to be driven to rotate independently from each other (to give a rotating speed difference to the registration rollers 201 and 202) and causes the registration rollers 201 and 202 to convey the sheet while causing the rollers to perform skew correction (ACT 204).

On the other hand, if a skew amount determined by the skew determining unit 101 is equal to or larger than the predetermined value (ACT 203, Yes), the driving control unit 102' sets sheet conveying speed of the registration rollers 201 and 202 lower than sheet conveying speed set when a skew amount determined by the skew determining unit 101 is smaller than the predetermined value and causes the registration rollers 201 and 202 to perform the skew correction (the first mode) ACT 206). Alternatively, the driving control unit 102' temporarily stops the sheet conveyance by the registration rollers 201 and 202 (the second mode) (ACT 207).

To allow the sheet conveying apparatus to convey both a narrow sheet and a wide sheet, it is necessary to provide nips of the respective conveying roller pairs in a wide range in the rotation axis direction. In this case, when the wide sheet is conveyed, a slip amount of the sheet in the roller nips increases and skew correction control may be unstable when a skew amount is large.

Therefore, a skew amount of the sheet is detected by the upstream-side skew detecting unit 701 before the sheet enters the nip of the registration rollers 201 and 202. When the skew amount exceeds a fixed skew amount, the skew amount is reduced by a certain degree by a method of, for example, bumping the leading end of the sheet against the nip of the registration rollers 202 and 202 in a stopped state. Thereafter, the skew amount not completely removed is reduced by using the rotation speed difference between the registration rollers 201 and 202.

Determination concerning in which of the "first mode" and the "second mode" the driving control unit 102' performs the skew correction (ACT 205) is performed on the basis of information set and registered in, for example, the memory 802 by the user or in default. Besides, it may be automatically determined on the basis of information acquired by the information acquiring unit 103 which of the modes should be selected. A mode selection criteria in this case can be stored in the memory 802 or the like as, for example, rule information.

Subsequently, the skew determining unit 101 determines, on the basis of a detection result in the skew detecting unit 702, a skew amount of the sheet still remaining after the skew correction in ACT 204, ACT 206, or ACT 207 (Act 208).

The driving control unit 102' controls to drive, to reduce the skew amount determined by the skew determining unit 101, the registration rollers 201 and 202 independently from each other and convey the sheet (ACT 209).

The skew determining unit 101 determines, on the basis of a detection result in the skew detecting unit 703, a skew amount of the sheet still remaining after the skew correction in ACT 209 (ACT 210).

The driving control unit 102' controls to drive, to reduce the skew amount determined by the skew determining unit 101, the registration rollers 201 and 202 independently from each other (ACT 211).

Figure 14:
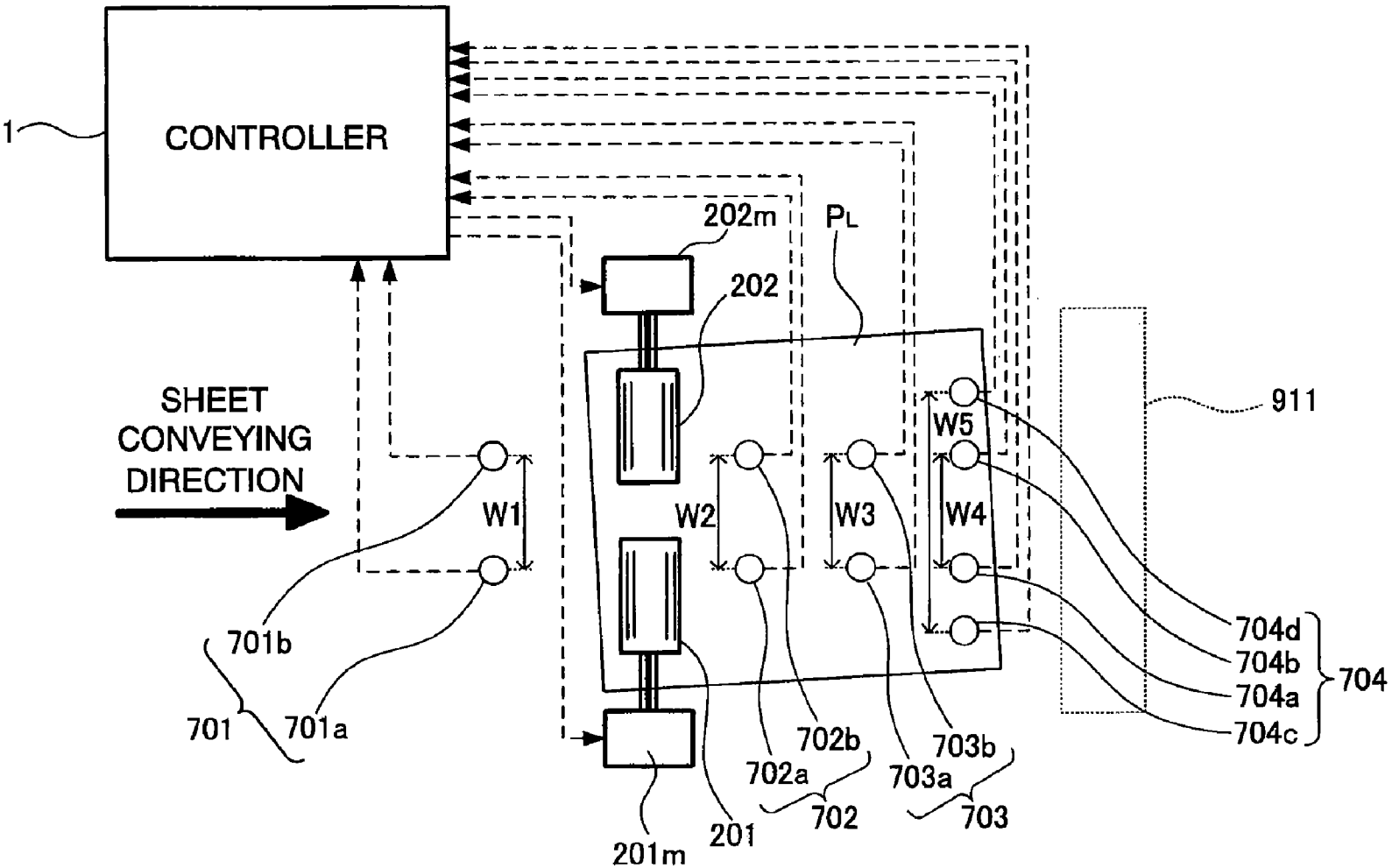
FIG. 14 is a diagram of a sheet conveyance state in the sheet conveying apparatus according to the second embodiment.

As an example, the skew determining unit 101 determines, on the basis of detection results of the sensors 704*c* and 704*d* configuring the skew detecting unit 704, a skew amount of the sheet still remaining after the skew correction in ACT 211 (ACT 212) (see FIG. 14). It goes without saying that, as explained in the first embodiment, in the determination of a skew amount by the skew determining unit 101, it is also possible to adopt a calculation algorithm for calculating a skew amount using not only detection values of the sensors 704*c* and 704*d* but also detection values of the sensors 704*a* and 704*b*.

The driving control unit 102' controls to drive, to reduce the skew amount determined by the skew determining unit 101, the registration rollers 201 and 202 independently from each other (ACT 213).

The control-amount correcting unit 104 corrects a control amount during the skew correction control by the driving control unit 102' for a sheet conveyed following the sheet $P_L$ as the conveyance target on the basis of a difference between a skew amount determined by the skew determining unit 101 on the basis of a detection result in the skew detecting unit 701 at the end PF on the downstream side in the sheet conveying direction of the sheet $P_L$ as the conveyance target and a skew amount determined by the skew determining unit 101 on the basis of a detection result in the skew detecting unit 701 at the end PR on the upstream side in the sheet conveying direction of the sheet conveyed by the registration rollers 201 and 202 to a transfer position (or an original scanning position or the like in an image scanning apparatus) in a state in which the skew correction control by the driving control unit 102' is not performed (ACT 214).

The sheet P as the conveyance target in the sheet conveying apparatus is often rectangular with exceptions. Usually, skew amounts of the leading end PF of the sheet P and skew amounts of the trailing end PR of the sheet P coincide with each other. When the registration rollers are used for a long period, it is likely that roller characteristics and the like change and accuracy of skew correction is deteriorated if the skew correction control alone is performed. For example, an optimum correction coefficient β could change with time.

In such a case, the trailing end PR of the sheet P subjected to the skew correction is detected by the skew correcting unit 702. This makes it possible to recognize a skew amount still remaining after the skew correction and apply appropriate correction to the sheet P when the sheet P is conveyed after that. In general, in order to detect deterioration in skew correction accuracy by the registration rollers, it is desirable to detect a trailing end of a sheet with the skew detecting unit 702 located near the downstream side of the registration rollers in the sheet conveying direction. However, when it is difficult to detect the trailing end of the sheet after skew correction by the skew detecting unit 702 because of limitations in design such as an apparatus configuration and processing speed, the trailing end of the sheet may be detected by other skew detecting units (e.g., the skew detecting units 703 and 704).

Consequently, it is possible to detect aged deterioration of the skew correction accuracy due to fluctuation in a conveyance characteristic and the like of the registration rollers. In this embodiment, the sensor pair used for detecting a leading end of a sheet and performing skew correction and the sensor pair for checking whether skew is appropriately corrected are the same. Therefore, it is unnecessary to secure a space for additionally arranging a sensor pair and it is possible to contribute to space saving and cost reduction.

In the configuration according to this embodiment, when skew detection for the sheet trailing end PR is performed by the upstream-side skew detecting unit 701, since the vicinity of the sheet trailing end PR is nipped by the registration rollers 201 and 202, it is possible to suppress flopping of the sheet trailing end PR and realize stable skew detection in the upstream-side skew detecting unit 701.

In this embodiment, the sheet leading end PF is detected to correct skew of the sheet P, it is determined whether the skew is corrected at the sheet trailing end PR and, when a skew amount is not completely corrected, a skew correction control amount is corrected when the following or next sheet is conveyed to compensate for a change in conveyance characteristics with time.

When a skew amount at the time when the sheet leading end PF is detected is zero, the skew correction control is not performed. However, even in such a case, a skew amount of the sheet trailing end PR could be detected. When a sheet is rectangular, this indicates that the origin of skew control by the registration rollers 201 and 202 as skew correcting means deviates.

Specifically, it is conceivable that outer diameters of the registration rollers 201 and 202 fluctuate because of aged deterioration such as abrasion. Even if the rotating speeds of the motors 201*m* and 202*m* are set the same, if the outer diameters of the registration rollers 201 and 202 are different, a difference is caused in sheet conveying speed by each of the registration rollers 201 and 202.

In order to solve such a problem, in this embodiment, the registration rollers 201 and 202 are caused to perform sheet conveyance in a state in which skew correction is not performed by the registration rollers (a state in which sheet conveying speeds of both the registration rollers are set to be the same). When a skew amount at the sheet leading end PF and a skew amount at the sheet trailing end PR are different, on the assumption that speeds of the registration rollers 201 and 202 are different, the speeds are adjusted to be the same. For example, driving speed of a roller pair that tends to be fast is reduced and driving speed of a roller pair that tends to be slow is increased. This makes it possible to perform origin adjustment in control of sheet conveying speed by the registration rollers 201 and 202.

According to this embodiment, each skew correction section can be secured long as compared to that in the case where skew correction is controlled by dividing the section in which skew correction in the sheet conveying direction is performed is divided into two or more, whereby generation of wrinkles and the like due to skew correction in a large degree within a short section can be prevented.

Third Embodiment

A third embodiment of the present invention is explained below.

The third embodiment is a modification of the first embodiment. In the following explanation, in this embodiment, components having functions same as those explained in the first embodiment are denoted by the same reference numerals and signs and explanation of the components is omitted.

Figure 15:
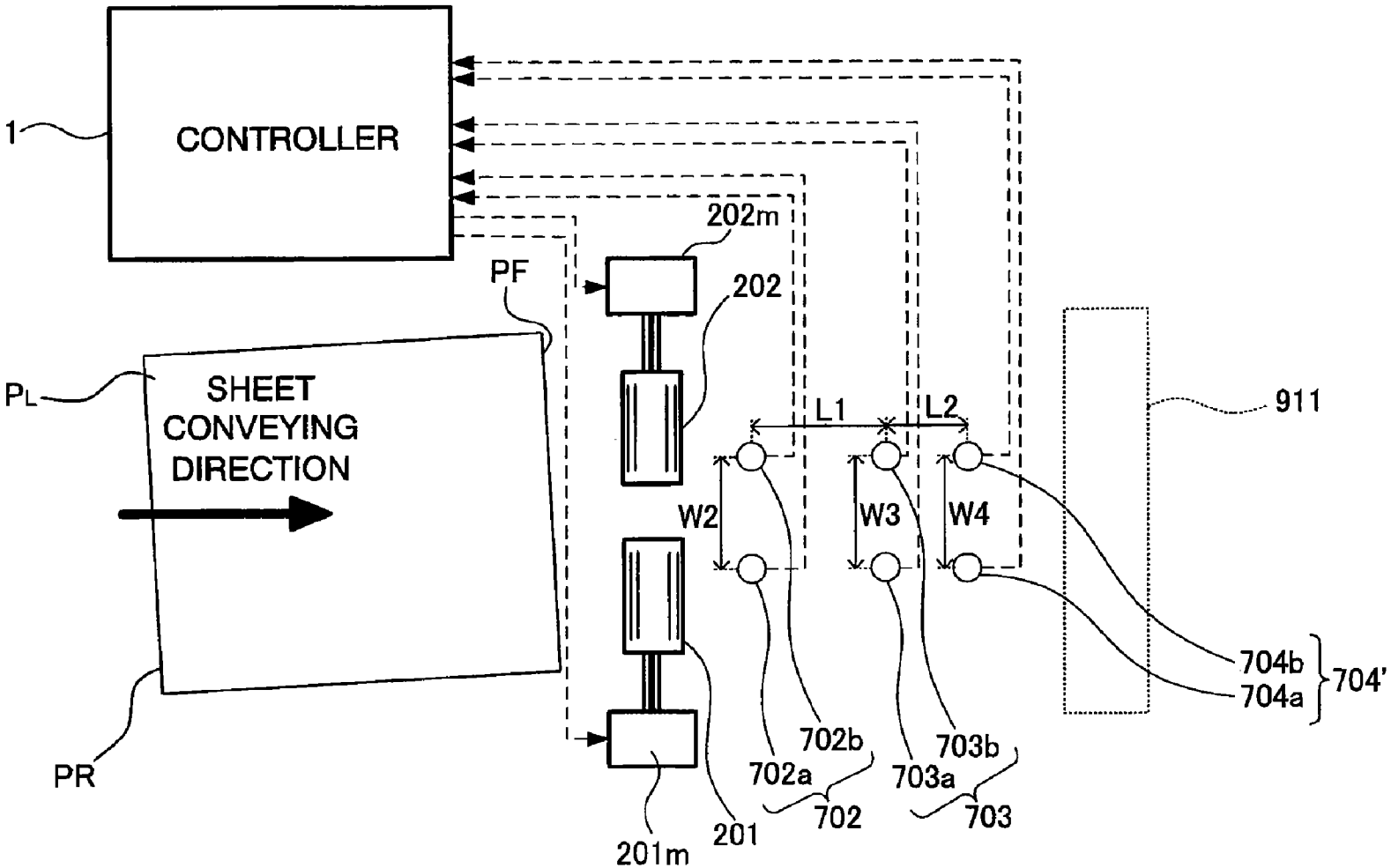
FIG. 15 is a diagram of a schematic configuration of the vicinity of registration rollers viewed from above in a sheet conveying apparatus according to a third embodiment of the present invention.

FIG. 15 is a diagram of a schematic configuration of the vicinity of registration rollers viewed from above in a sheet conveying apparatus according to the third embodiment. The sheet conveying apparatus according to this embodiment is different from the sheet conveying apparatuses according to the first and second embodiments in the arrangement of a skew detecting unit 704' as a sensor pair corresponding to the skew detecting unit 704.

In the first and second embodiments, among the plural skew detecting units arranged in the sheet conveying direction, the skew detecting unit 704 located on the most downstream side in the sheet conveying direction includes four sensors. However, in the sheet conveying apparatus according to this embodiment, the skew detecting unit 704' located on the most downstream side in the sheet conveying direction includes two sensors.

In the configuration adopted in the first and second embodiments, the skew detecting unit 702, the skew detecting unit 703, and the skew detecting unit 704 are arranged at equal intervals in the sheet conveying direction. However, in this embodiment, an interval L2 (corresponding to the first section) between the skew detecting unit 703 and the skew detecting unit 704' in the sheet conveying direction is set shorter than an interval L1 (corresponding to the second section) between the skew detecting unit 702 and the skew detecting unit 703 (a skew detecting unit arranged further on the upstream side in the sheet conveying direction than the first section) in the sheet conveying direction.

In this way, the interval of the section between the skew detecting units in the sheet conveying direction is set narrower on the downstream side in the sheet conveying direction. Therefore, a time interval from sheet detection timing of the skew detecting unit 703 to sheet detection timing of the skew detecting unit 704 can be set shorter than a time interval from sheet detection timing of the skew detecting unit 702 located on the upstream side in the sheet conveying direction to skew detection timing of the skew detecting unit 703.

Consequently, it is possible to set a sampling interval of sheet skew detection in the section from the skew detecting unit 703 to the skew detecting unit 704 shorter than that in the section from the skew detecting unit 702 located on the upstream side in the sheet conveying direction to the skew detecting unit 703. It is possible to realize finer skew correction.

Further, in the sheet conveying apparatuses according to the first and second embodiments, only sheets having width equal to or larger than the width $W_{PL}$ of the sheet $P_L$ most frequently conveyed (set as a target of image formation) among the sheets of the sizes on which images can be formed by the image forming unit 9 are detection targets of the sensors 704*c* and 704*d* set for the purpose of performing highly accurate skew detection. For example, skew of a narrow sheet such as a sheet of the postcard size is not detected.

On the other hand, in the sheet conveying apparatus according to this embodiment, as a method of improving sheet skew detection accuracy, a space in the direction orthogonal to the sheet conveying direction between a sensor pair is not increased but a section between skew detecting units in the sheet conveying direction is reduced. This realizes highly accurate skew detection even for a sheet having a narrow size for which highly accurate skew detection cannot be performed by the configurations according to the first and second embodiments. Consequently, it is possible to realize improvement of sheet conveying performance for such a sheet having a narrow size and contribute to improvement of an image quality in image formation processing.

The sheet skew detection accuracy is improved by reducing the interval between the skew detecting units in the sheet conveying direction. Consequently, it is possible to reduce an arrangement space for the skew detecting units in the sheet conveying direction and contribute to space saving of the apparatus as a whole.

Fourth Embodiment

A fourth embodiment of the present invention is explained below.

The fourth embodiment is a modification of the third embodiment. In the following explanation, in this embodiment, components having functions same as those explained in the third embodiment are denoted by the same reference numerals and signs and explanation of the components is omitted.

Figure 16:
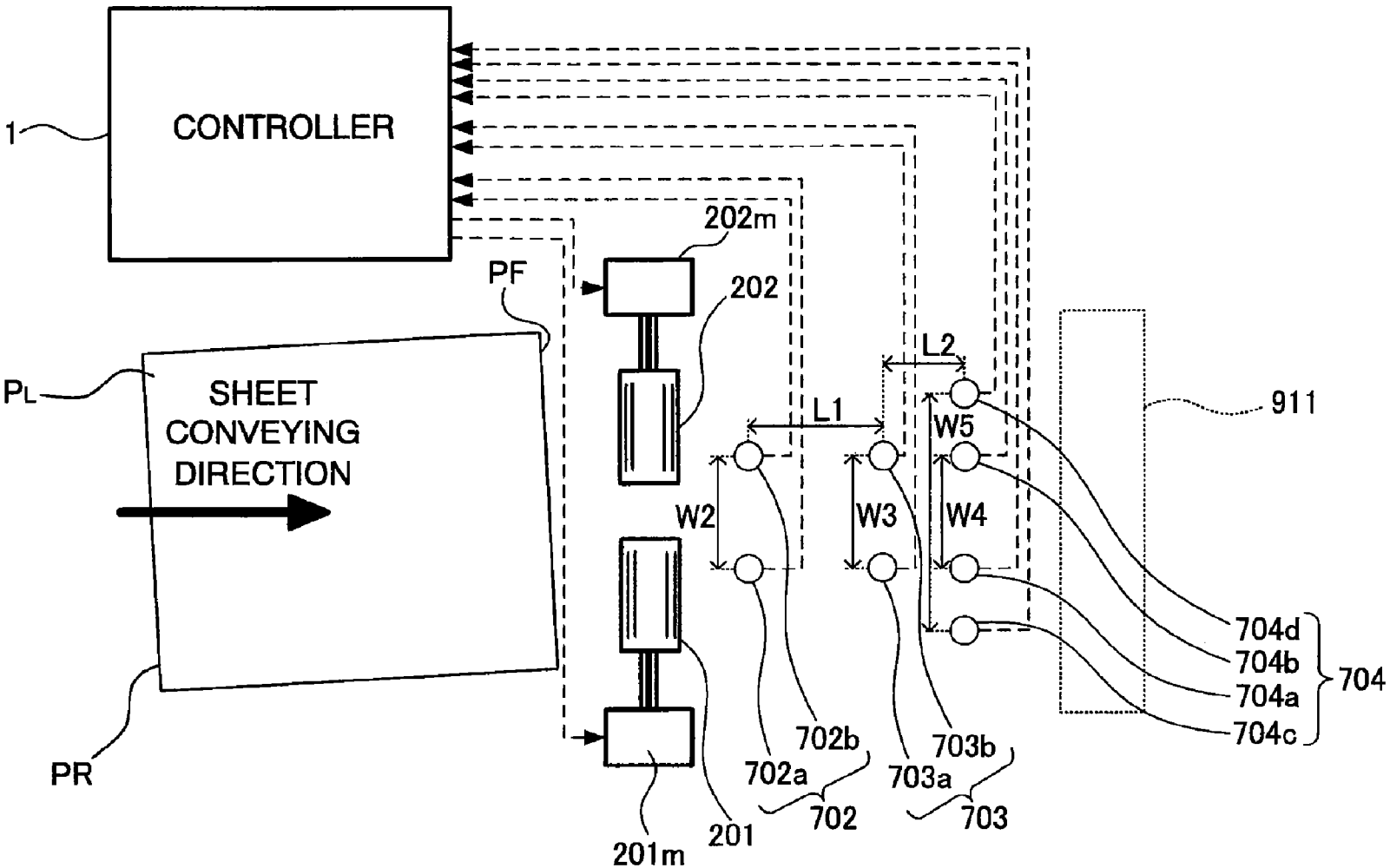
FIG. 16 is a diagram of a schematic configuration of the vicinity of registration rollers viewed from above in a sheet conveying apparatus according to a fourth embodiment of the present invention.

FIG. 16 is a diagram of a schematic configuration of the vicinity of registration rollers viewed from above in a sheet conveying apparatus according to the fourth embodiment. The sheet conveying apparatus according to this embodiment is different from the sheet conveying apparatus according to the third embodiment in the arrangement of the sensor pair configuring the skew detecting unit 704.

Specifically, the skew detecting unit 704 in this embodiment includes the four sensors 704*a* to 704*d*. The sensor arrangement in the direction orthogonal to the sheet conveying direction of the skew detecting unit 704 is the same as that in the first and second embodiment.

Concerning the intervals among the skew detecting units in the sheet conveying direction, as in the third embodiment, the interval L2 between the skew detecting unit 703 and the skew detecting unit 704 in the sheet conveying direction is set shorter than the interval L1 between the skew detecting unit 702 and the skew detecting unit 703 in the sheet conveying direction.

By adopting such sensor arrangement, as in the sheet conveying apparatuses explained in the first and second embodiments, it is possible to improve skew detection accuracy for a narrow sheet such as a sheet of the postcard size while improving skew detection accuracy for a wide sheet such as a sheet of the A4-R size.

Fifth Embodiment

A fifth embodiment of the present invention is explained below.

The fifth embodiment is a modification of the fourth embodiment. In the following explanation, in this embodiment, components having functions same as those explained in the fourth embodiment are denoted by the same reference numerals and signs and explanation of the components is omitted.

Figure 17:
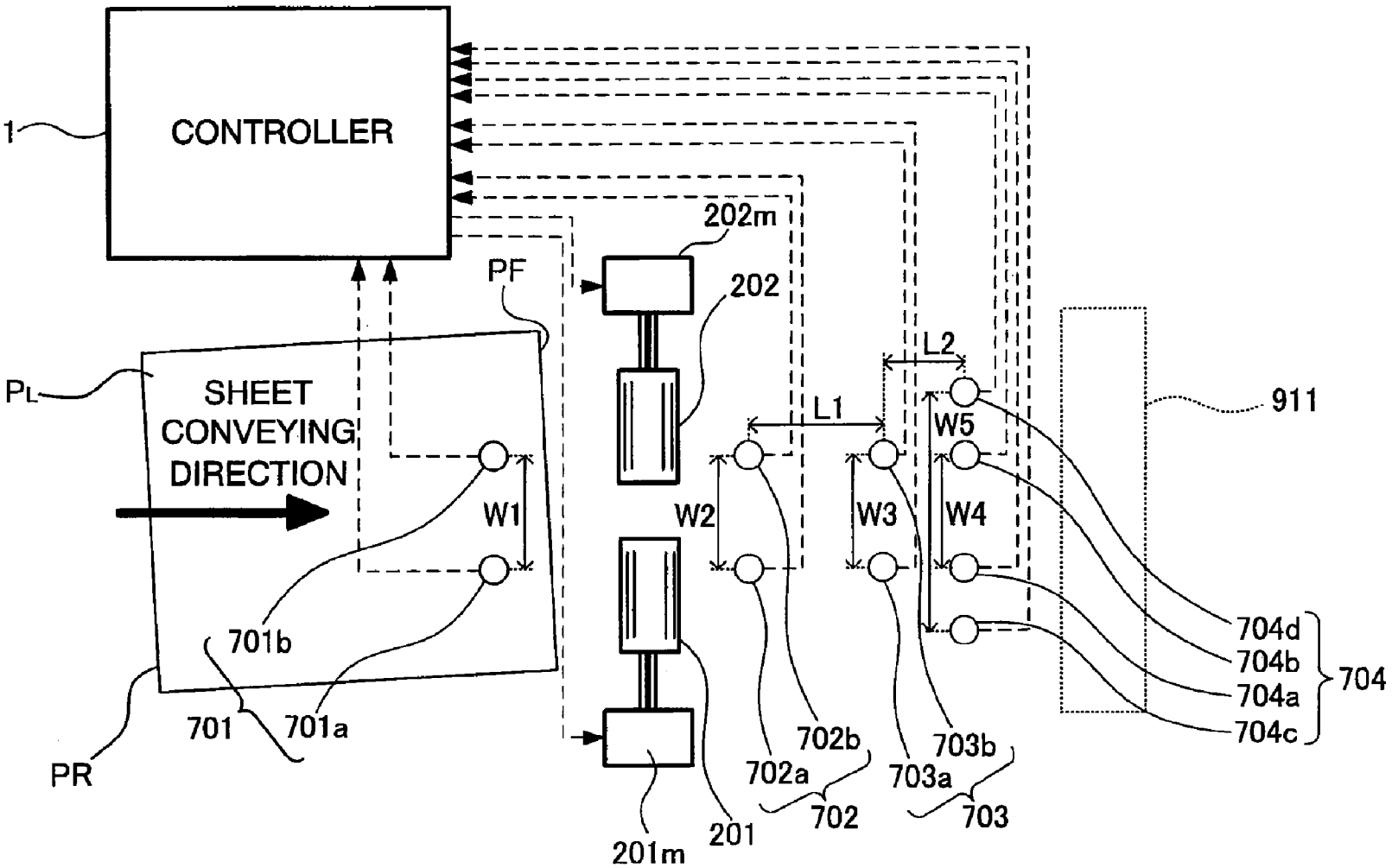
FIG. 17 is a diagram of a schematic configuration of the vicinity of registration rollers viewed from above in a sheet conveying apparatus according to a fifth embodiment of the present invention.

FIG. 17 is a diagram of a schematic configuration of the vicinity of registration rollers viewed from above in a sheet conveying apparatus according to the fifth embodiment. The sheet conveying apparatus according to this embodiment is different from the sheet conveying apparatus according to the fourth embodiment in sensor arrangement further on the upstream side in the sheet conveying direction than the registration rollers 201 and 202.

Specifically, in the sheet conveying apparatus according to this embodiment, the upstream-side skew detecting unit 701 in which at least two sensors (the sensors 701*a* and 701*b*) are arranged in the direction orthogonal to the sheet conveying direction (see FIG. 17) is provided in the vicinity on the upstream side in the sheet conveying direction of the registration roller 201 (the first roller) and the registration roller 202 (the second roller).

By adopting such a configuration, when skew detection for the sheet trailing end PR is performed by the upstream-side skew detecting unit 701, since the vicinity of the sheet trailing end PR is nipped by the registration rollers 201 and 202, it is possible to suppress flopping of the sheet trailing end PR and realize stable skew detection in the upstream-side skew detecting unit 701.

Further, a skew amount of a sheet is detected by the upstream-side skew detecting unit 701 before the sheet reaches the registration rollers 201 and 202 to cause the registration roller pair to start sheet conveyance in a state in which a rotation speed difference for making it possible to reduce skew of the sheet is given to the registration roller pair. Therefore, compared with the configuration according to the first embodiment for performing skew detection for a sheet that passes through the registration rollers 201 and 202, it is possible to reduce a sheet conveyance distance required until the sheet is subjected to skew correction.

Sixth Embodiment

A sixth embodiment of the present invention is explained below.

The sixth embodiment is a modification of the fifth embodiment. In the following explanation, in this embodiment, components having functions same as those explained in the fifth embodiment are denoted by the same reference numerals and signs and explanation of the components is omitted.

Figure 18:
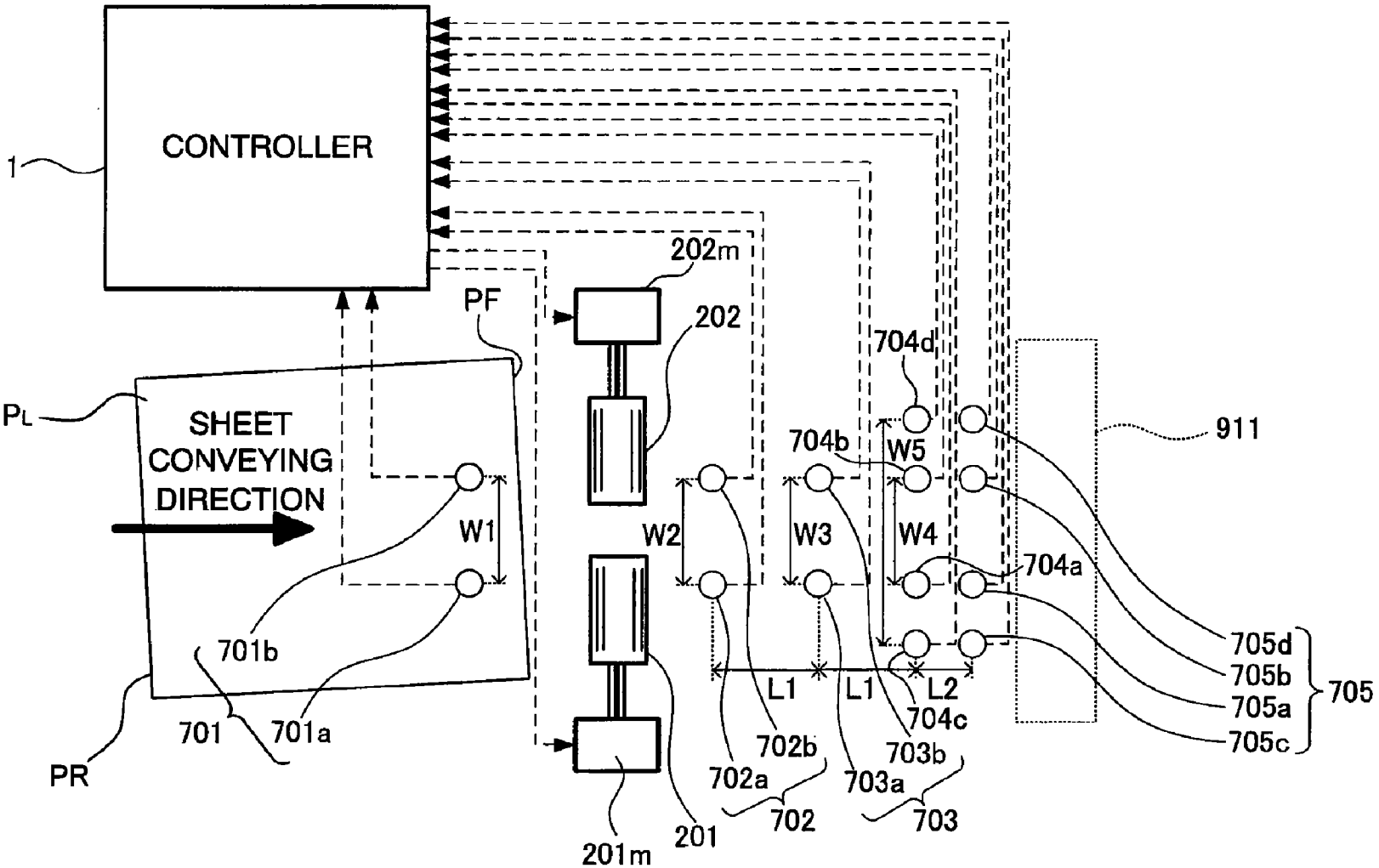
FIG. 18 is a diagram of a schematic configuration of the vicinity of registration rollers viewed from above in a sheet conveying apparatus according to a sixth embodiment of the present invention.

FIG. 18 is a diagram of a schematic configuration of the vicinity of registration rollers viewed from above in a sheet conveying apparatus according to the sixth embodiment. The sheet conveying apparatus according to this embodiment is different from the sheet conveying apparatus according to the fifth embodiment in sensor arrangement further on the downstream side in the sheet conveying direction than the registration rollers 201 and 202.

Specifically, in the sheet conveying apparatus according to this embodiment, a skew detecting unit 705 (see FIG. 18) including four sensors (sensors 705*a* to 705*d*) arranged in the direction orthogonal to the sheet conveying direction is further provided on the downstream side in the sheet conveying direction of the skew detecting unit 704.

In a configuration according to this embodiment, two sets of sensor pairs (a pair of sensors 705*a* and 705*b* and a pair of sensors 705*c* and 705*d*) are provided to be arranged near the downstream side of not only the sensor pair (the sensors 704*a* and 704*b*) arranged at the narrow space in the sheet conveying direction but also the sensor pair (the sensors 704*c* and 704*d*) arranged at the wide space.

Consequently, for example, when a wide sheet such as the sheet of the A4-R size is conveyed, it is possible not only to perform highly accurate skew detection with the sensor pair (the sensors 704*c* and 704*d*) arranged at the wide space (see, for example, the first embodiment) but also to perform the highly accurate skew detection by the sensor pair arranged at the wide space again in a short time. Therefore, it is possible to highly accurately and finely detect transition of a skew amount of the sheet.

In the examples explained in the embodiments, the "reflection sensor" that detects reflected light from a sheet as a conveyance target is adopted as the sensors configuring the skew detecting units. However, the present invention is not limited to this. It goes without saying that it is also possible to adopt, for example, a "transmission sensor" that detects transmission or non-transmission of transmitted light due to passage of the sheet as the conveyance target and an "optical sensor" that is turned on and off by an action of a lever member corresponding to contact of the sheet as the conveyance target.

Figure 19:
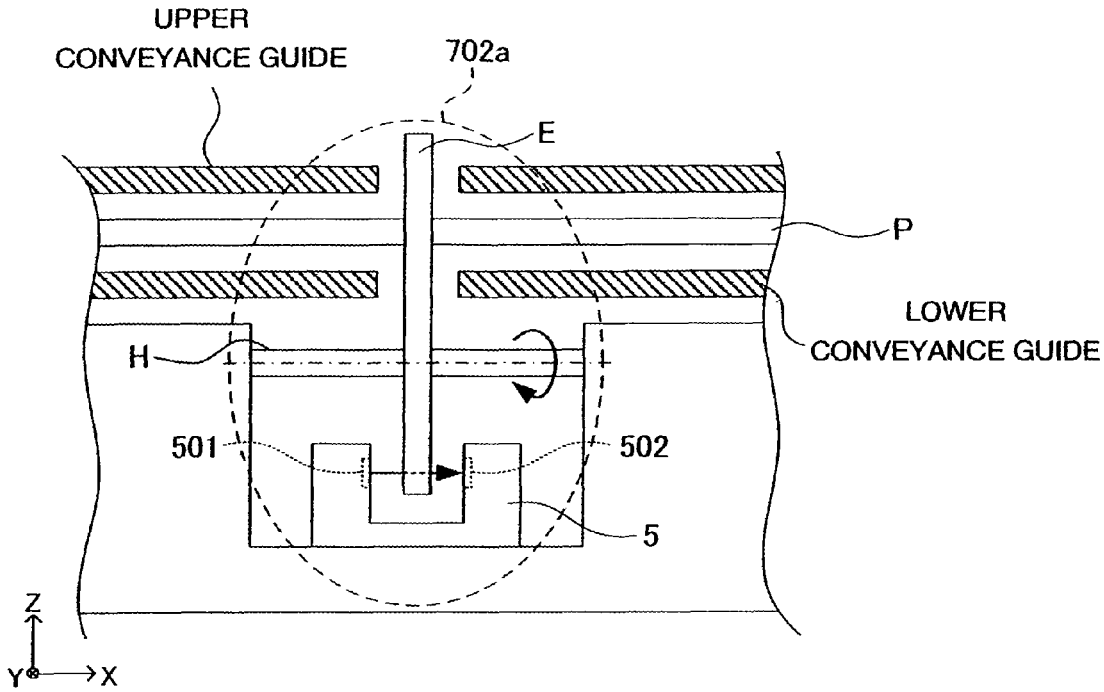
FIG. 19 is a sectional view of the vicinity of a sensor 702*a* taken along a plane orthogonal to a conveying direction of a sheet P.
Figure 20:
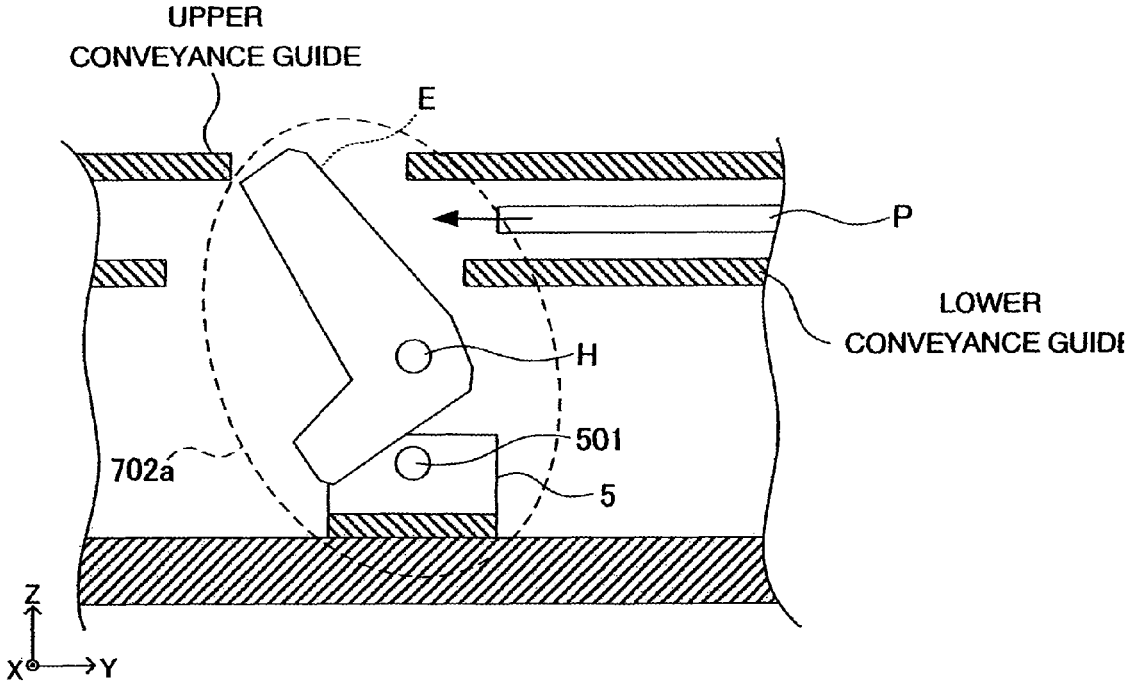
FIG. 20 is a sectional view of the vicinity of the sensor 702*a* taken along a vertical surface parallel to the conveying direction of the sheet P.
Figure 21:
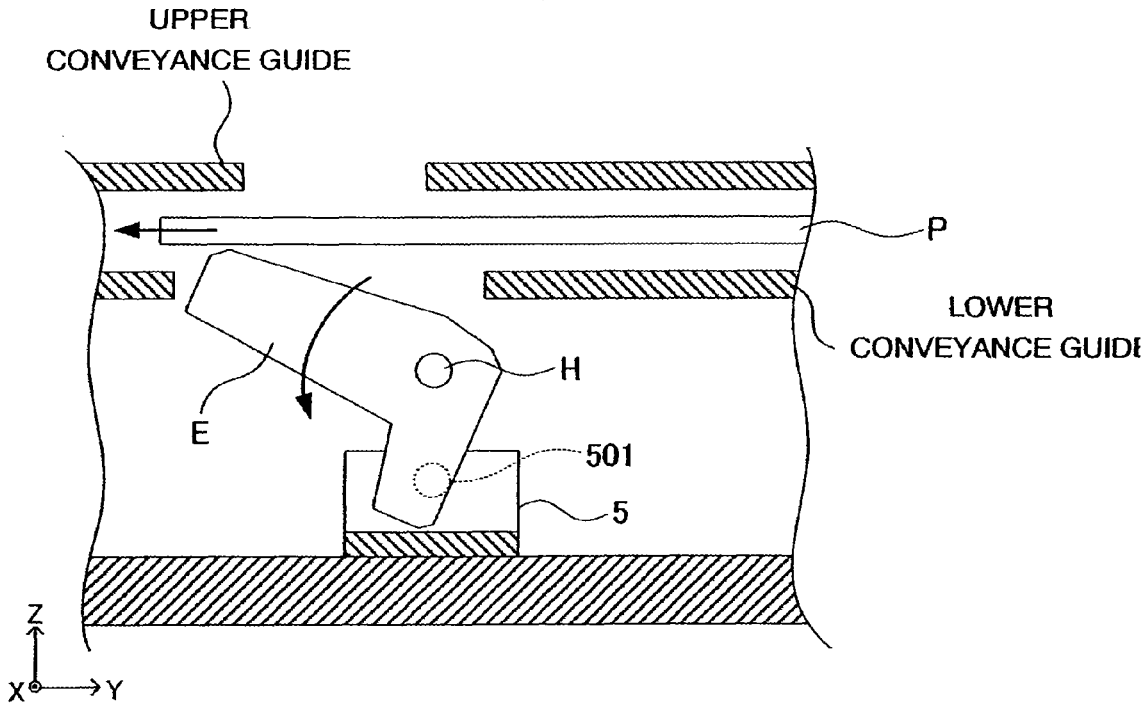
FIG. 21 is a sectional view of a state in which a lever member is pivoted by contact of the sheet P.

FIGS. 19 to 21 are diagrams of other examples of a configuration of a sensor (e.g., the sensor 702*a* configuring the skew detecting unit 702) that is turned on and off by an action of a lever member corresponding to contact of a sheet. FIG. 19 is a sectional view of the vicinity of the sensor 702*a* taken along a plane orthogonal to the conveying direction of the sheet P. FIG. 20 is a sectional view of the vicinity of the sensor 702*a* taken along a vertical surface parallel to the conveying direction of the sheet P. FIG. 21 is a sectional view of a state in which the lever member is pivoted by contact of the sheet P.

As shown in FIGS. 19 to 21, the sensor 702*a* includes a transmission sensor 5 and a lever member E that can rotate around a predetermined rotating shaft H. The lever member E is urged in a clockwise direction in FIG. 20 by a not-shown elastic member such as a spring. When the sheet P conveyed in an arrow direction between an upper conveyance guide and a lower conveyance guide comes into contact with the lever member E, the lever member E can retract in a counterclockwise direction. As shown in FIG. 20, the lever member E is formed in, for example, an L shape.

The transmission sensor 5 includes a light emitting unit 501 and a light receiving unit 502 that receives light emitted from the light emitting unit 501 and performs photoelectric conversion based on the received light.

A principle of sheet detection by the sensor 702*a* is explained below.

In a standby state in which the sheet leading end PF does not come into contact with the lever member E, the lever member E is urged to a predetermined standby position (see FIG. 20). The light receiving unit 502 receives light emitted from the light emitting unit 501 (a sensor OFF state).

On the other hand, when the leading end PF of the sheet P conveyed between the upper conveyance guide and the lower conveyance guide comes into contact with the lever member E, the lever member E retracts in a direction for not preventing advance in the conveying direction of the sheet P while rotating around the rotating shaft H (see FIG. 21). An end of the L-shaped lever member on a side close to the transmission sensor 5 blocks light traveling from the light emitting unit 501 to the light receiving unit 502 (a sensor ON state).

The sensor 702*a* detects passage of a sheet leading end or trailing end in this way.

In the examples explained in the embodiments, each of the skew detecting units includes the plural sensor groups arranged in the direction orthogonal to the sheet conveying direction. However, the present invention is not limited to this. For example, it is also possible to configure any one of the plural skew detecting units with a line sensor or the like.

In the embodiments, skew detection accuracy of the skew detecting unit located on the most downstream side in the sheet conveying direction is set the highest. However, concerning a skew detecting unit, near the downstream side of which components for which it is highly necessary to correct skew are arranged, among the plural skew detecting units arranged in the sheet conveying direction, it is considered effective to improve skew detection accuracy according to the method explained above even if the skew detecting unit is not located on the most downstream side (e.g., if the skew detecting unit is a skew detecting unit located second or third from the most downstream side).

The embodiments are explained on the premise that skew detecting units having the same sensitivity and response speed are used as the plural skew detecting units arranged in positions different from one another in the sheet conveying direction. However, the present invention is not limited to this. For example, it goes without saying that, in addition to the configurations of the embodiments, at least one of response speed and sensitivity of sheet detection by the skew detecting unit located on the most downstream side in the sheet conveying direction can be set to higher than that of the skew detecting unit located on the upstream side in the sheet conveying direction of the skew detecting unit located on the most downstream side. Therefore, if high-performance sensors are adopted in at least the skew detecting unit located on the most downstream side, it is possible to improve detection accuracy of the sensors configuring the skew detecting unit and highly accurately perform sheet skew detection by the skew detecting unit located on the most downstream side.

The acts in the processing in the sheet conveying apparatuses according to the embodiments are realized by causing the CPU 801 to execute a sheet conveying program stored in the memory 802.

In the examples explained in the embodiments, the computer program for realizing the functions for carrying out the invention is stored in advance in the storage area provided in the apparatus. However, the present invention is not limited to this. The same computer program may be downloaded from a network to the apparatus. The same computer program stored in a computer-readable recording medium may be installed in the apparatus. A form of the recording medium may be any form as long as the recording medium can store the computer program and is a computer-readable recording medium. Specifically, examples of the recording medium include internal storage devices implemented in the computer such as a ROM and a RAM, portable storage media such as a CD-ROM, a flexible disk, a DVD disk, a magneto-optical disk, and an IC card, a database that stores a computer program, other computers and databases for the computers, and a transmission medium on a line. Functions obtained by the installation and the download in this way in advance may realize the functions in cooperation with an OS (operating system) in the apparatus.

The computer program in the embodiments includes a computer program for dynamically generating an execution module.

The present invention is explained above in detail with reference to the specific embodiments. However, it would be obvious to those skilled in the art that various modifications and alterations are possible without departing from the spirit and the scope of the present invention.

As explained above in detail, according to the present invention, it is possible to provide a technique that can realize highly accurate skew correction without specially adopting a complicated apparatus configuration.

What is claimed is:

1. A sheet conveying apparatus comprising:

first and second rollers that are arranged in positions different from each other in a direction orthogonal to a sheet conveying direction and can be driven to rotate independently from each other;

a first skew detecting unit that is arranged on a downstream side of the first and second rollers in the sheet conveying direction and detects a skew of a sheet with a first skew detection accuracy, the first skew detecting unit comprising sensors which are arranged in positions different from each other in the direction orthogonal to the sheet conveying direction;

a second skew detecting unit that is arranged further on the downstream side than the first skew detecting unit in the sheet conveying direction and detects a skew of the sheet with a second skew detection accuracy which is higher than the first skew detection accuracy, the second skew detecting unit comprising sensors which are arranged in positions different from each other in the direction orthogonal to the sheet conveying direction and comprising more sensors than the first skew detecting unit;

a skew determining unit that determines a skew amount of the sheet on the basis of detection results of the respective first and second skew detecting units; and a driving control unit that controls to drive, to reduce the skew amount determined by the skew determining unit, the first and second rollers independently from each other and convey the sheet.

2. The apparatus according to claim 1, wherein each of the first and second skew detecting units is a sensor pair including at least two sensors arranged in positions different from each other in the direction orthogonal to the sheet conveying direction, and a space in the direction orthogonal to the sheet conveying direction between the sensor pair configuring the second skew detecting unit is set wider than a space between the sensor pair configuring the first skew detecting unit.

3. The apparatus according to claim 2, wherein the space between the sensor pair configuring the first skew detecting unit is narrower than a minimum sheet width set in advance, and the space between the sensor pair configuring the second skew detecting unit is wider than the minimum sheet width set in advance.

4. The apparatus according to claim 2, wherein the space between the sensor pair configuring the second skew detecting unit is set to a distance equivalent to 75% to 85% of a width in the direction orthogonal to the sheet conveying direction of a sheet having a size most frequently conveyed in the sheet conveying apparatus.

5. The apparatus according to claim 2, wherein the space between the sensor pair configuring the first skew detecting unit is set to a distance equivalent to 75% to 85% of a width of a sheet having smallest width in the direction orthogonal to the sheet conveying direction among predetermined plural sheets that can be conveyed in the sheet conveying apparatus.

6. The apparatus according to claim 1, wherein at least a trio of the skew detecting units are arranged in the sheet conveying direction, and an interval of a first section between a most downstream skew detecting unit located on a most downstream side and a skew detecting unit arranged adjacent to an upstream side of the most downstream skew detecting unit in the sheet conveying direction is smaller than an interval of a second section between skew detecting units arranged adjacent to each other further on the upstream side in the sheet conveying direction and the first section.

7. The apparatus according to claim 1, wherein the response speed of sheet detection by the second skew detecting unit is set to be higher than that of the first skew detecting unit.

8. The apparatus according to claim 1, further comprising an upstream-side skew detecting unit arranged near the upstream side of the first and second rollers in the sheet conveying direction, wherein the driving control unit sets, when a sheet, an end on the downstream side in the sheet conveying direction of which is detected by the upstream-side skew detecting unit, enters a nip of the first and second rollers, rotating speeds of the first and second rollers different from each other to correct skew of the sheet.

9. The apparatus according to claim 8, further comprising a control-amount correcting unit that corrects a control amount during skew correction control by the driving control unit for a sheet conveyed following a sheet as a conveyance target on the basis of a difference between a skew amount determined by the skew determining unit on the basis of a detection result in the upstream-side skew detecting unit at an end on the downstream side in the sheet conveying direction of the sheet as the conveyance target and a skew amount determined by the skew determining unit on the basis of a detection result in the upstream-side skew detecting unit at an end on the upstream side in the sheet conveying direction of the sheet conveyed by the first and second rollers in a state in which the skew correction control by the driving control unit is not performed.

10. The apparatus according to claim 1, wherein a distance in the sheet conveying direction from a nip of the first and second rollers to a skew detecting unit located on a most downstream side in the sheet conveying direction is smaller than a length in the sheet conveying direction of a sheet as a conveyance target.

11. The apparatus according to claim 1, wherein the first and second skew detecting units include at least one of a reflection sensor that detects reflected light from a sheet as a conveyance target, a transmission sensor that detects transmission or non-transmission of transmitted light due to passage of the sheet as the conveyance target, and an optical sensor that is turned on and off by an action of a lever member responding to contact of the sheet as the conveyance target.

12. The apparatus according to claim 1, wherein the driving control unit sets, when a skew amount determined by the skew determining unit is equal to or larger than a predetermined value, a sheet conveying speed of the first and second roller lower than a sheet conveying speed set when a skew amount determined by the skew determining unit is smaller than the predetermined value and causes the first and second rollers to perform skew correction.

13. The apparatus according to claim 1, wherein the driving control unit stops a sheet conveyance by the first and second rollers when a skew amount determined by the skew determining unit is equal to or larger than a predetermined value.

14. The apparatus according to claim 1, further comprising an information acquiring unit that acquires information concerning a type of a sheet as a conveyance target in the sheet conveying apparatus, wherein the driving control unit performs mode switching between a first mode for setting, when a skew amount determined by the skew determining unit is equal to or larger than a predetermined value, a sheet conveying speed of the first and second rollers lower than a sheet conveying speed set when a skew amount determined by the skew determining unit is smaller than the predetermined value and causing the first and second rollers to perform skew correction and a second mode for stopping, when a skew amount determined by the skew determining unit is equal to or larger than the predetermined value, a sheet conveyance by the first and second rollers to perform skew correction and then resuming the sheet conveyance on the basis of information acquired by the information acquiring unit.

15. A sheet conveying apparatus comprising:

first and second rollers that are arranged in positions different from each other in a direction orthogonal to a sheet conveying direction and can be driven to rotate independently from each other;

at least three skew detecting units that are arranged in positions different from one another in the sheet conveying direction on a downstream side of the first and second rollers in the sheet conveying direction and in which an interval of a first section between a most downstream skew detecting unit located on the most downstream side and a skew detecting unit arranged to be adjacent to an upstream side of the most downstream skew detecting unit is set to be smaller than an interval of a second section between skew detecting units arranged to be adjacent to each other further on the upstream side in the sheet conveying direction and the first section, each of the three skew detecting units comprising sensors which are arranged in positions different from each other in the direction orthogonal to the sheet conveying direction, the most downstream skew detecting unit comprising more sensors than each of the other skew detecting units;

a skew determining unit that determines a skew amount of the sheet on the basis of detection results of the respective plural skew detecting units; and a driving control unit that controls to drive, to reduce the skew amount determined by the skew determining unit, the first and second rollers independently from each other and convey the sheet.

16. A sheet conveying method in a sheet conveying apparatus including: first and second rollers that are arranged in positions different from each other in a direction orthogonal to a sheet conveying direction and can be driven to rotate independently from each other; a first skew detecting unit that is arranged on a downstream side of the first and second rollers in the sheet conveying direction and detects a skew of a sheet with a first skew detection accuracy, the first skew detecting unit comprising sensors which are arranged in positions different from each other in the direction orthogonal to the sheet conveying direction; and a second skew detecting unit that is arranged further on the downstream side than the first skew detecting unit in the sheet conveying direction and detects a skew of the sheet with a second skew detection accuracy which is higher than the first skew detection accuracy, the second skew detecting unit comprising sensors which are arranged in positions different from each other in the direction orthogonal to the sheet conveying direction and comprising more sensors than the first skew detecting unit, the sheet conveying method comprising:

determining a skew amount of the sheet on the basis of detection results of the first skew detecting unit that comprises sensors which are arranged in positions different from each other in the direction orthogonal to the sheet conveying direction and the second skew detecting unit that comprises sensors which are arranged in positions different from each other in the direction orthogonal to the sheet conveying direction and more sensors than the first skew detecting unit; and controlling to drive, to reduce the skew amount determined by the skew determining unit, the first and second rollers independently from each other and convey the sheet.

17. The method according to claim 16, wherein each of the first and second skew detecting units is a sensor pair including at least two sensors arranged in positions different from each other in the direction orthogonal to the sheet conveying direction, and a space in the direction orthogonal to the sheet conveying direction between the sensor pair configuring the second skew detecting unit is set wider than a space between the sensor pair configuring the first skew detecting unit.

18. The method according to claim 16, wherein the response speed of sheet detection by the second skew detecting unit is set to be higher than that of the first skew detecting unit.

19. The method according to claim 16, wherein the sheet conveying apparatus further includes an upstream-side skew detecting unit arranged near the upstream side of the first and second rollers in the sheet conveying direction, and the method further including setting, when a sheet, an end on the downstream side in the sheet conveying direction of which is detected by the upstream-side skew detecting unit, enters a nip of the first and second rollers, rotating speeds of the first and second rollers different from each other to correct skew of the sheet.

20. The method according to claim 18, further comprising correcting a control amount during skew correction control by the driving control unit for a sheet conveyed following a sheet as a conveyance target on the basis of a difference between a skew amount determined by the skew determining unit on the basis of a detection result in the upstream-side skew detecting unit at an end on the downstream side in the sheet conveying direction of the sheet as the conveyance target and a skew amount determined by the skew determining unit on the basis of a detection result in the upstream-side skew detecting unit at an end on the upstream side in the sheet conveying direction of the sheet conveyed by the first and second rollers in a state in which the skew correction control by the driving control unit is not performed.

* * * * *